US007926277B2

(12) United States Patent
Harpster

(10) Patent No.: US 7,926,277 B2
(45) **Date of Patent: *Apr. 19, 2011**

(54) CONDENSERS AND THEIR MONITORING

(76) Inventor: Joseph W. C. Harpster, Punta Gorda, FL (US)

( * ) Notice: Subject to any disclaimer, the term of this patent is extended or adjusted under 35 U.S.C. 154(b) by 1183 days.

This patent is subject to a terminal disclaimer.

(21) Appl. No.: 11/358,433

(22) Filed: Feb. 21, 2006

(65) Prior Publication Data

US 2006/0150630 A1 Jul. 13, 2006

Related U.S. Application Data

(62) Division of application No. 10/703,850, filed as application No. PCT/US02/12038 on Apr. 16, 2002, now Pat. No. 7,065,970.

(51) Int. Cl.
*F01B 31/16* (2006.01)

(52) U.S. Cl. ..... 60/685

(58) Field of Classification Search ..... 60/685, 60/690

See application file for complete search history.

(56) References Cited

U.S. PATENT DOCUMENTS 2,963,872 A * 12/1960 Latimer ..... 62/643
6,526,755 B1 * 3/2003 Harpster ..... 60/690
7,065,970 B2 * 6/2006 Harpster ..... 60/685

* cited by examiner

*Primary Examiner* — Hoang M Nguyen
(74) *Attorney, Agent, or Firm* — Mueller Smith & Okuley, LLC

(57) ABSTRACT

Disclosed is a method for operating a condenser of the type having a housing inside of which is disposed a bundle of water tubes, a steam inlet for steam to flow inside the housing for contacting the tube bundle for cooling, and having a stagnant air zone during operation wherein any air in-leakage preferentially collects and condensate in the air zone becomes subcooled. A trough or drain is placed beneath the stagnant air zone for collecting subcooled condensate from the stagnant air zone. Collected subcooled condensate is transported from the trough or drain in a pipe to said steam inlet. The transported condensate is injected with an injector for contacting with steam entering the condenser, whereby the injected condensate is heated by the steam for expelling dissolved oxygen in the injected condensate. Advantageously, the condenser is fitted with an array of temperature sensors at the stagnant air zone for determination of its presence and/or size. Additionally, disclosed is a method for preventing air bound zones in the tube bundle sections of the condenser.

22 Claims, 14 Drawing Sheets

FIG. 3A
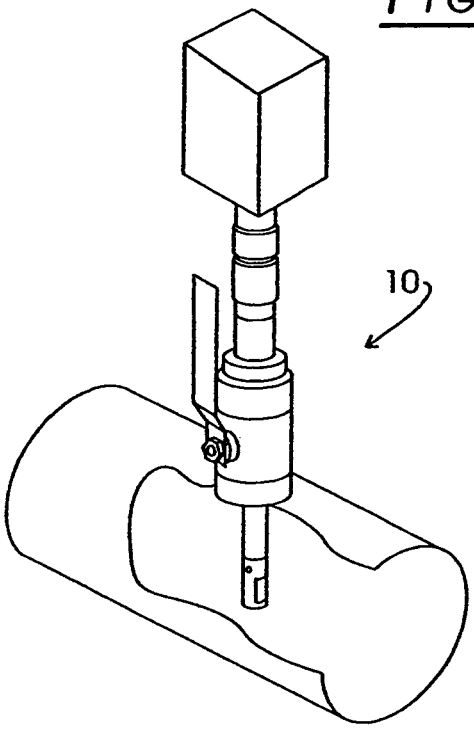
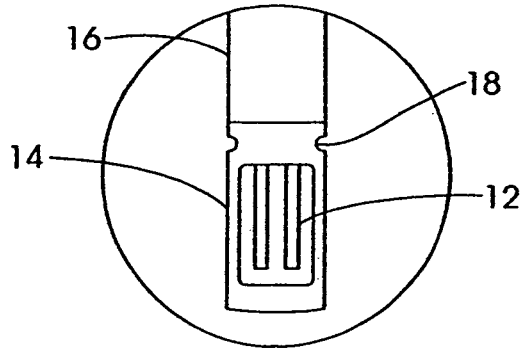
FIG. 3B
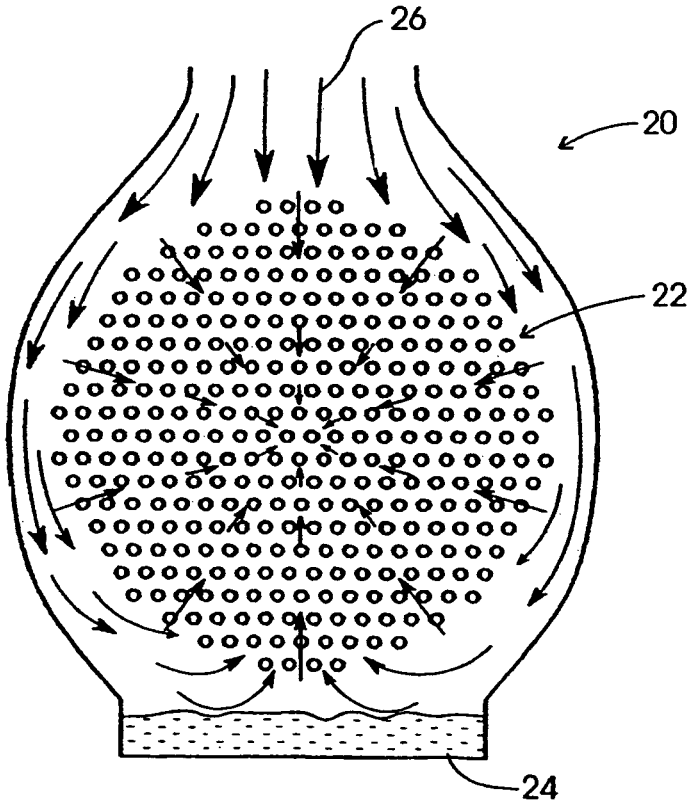
FIG. 4

FIG. 8
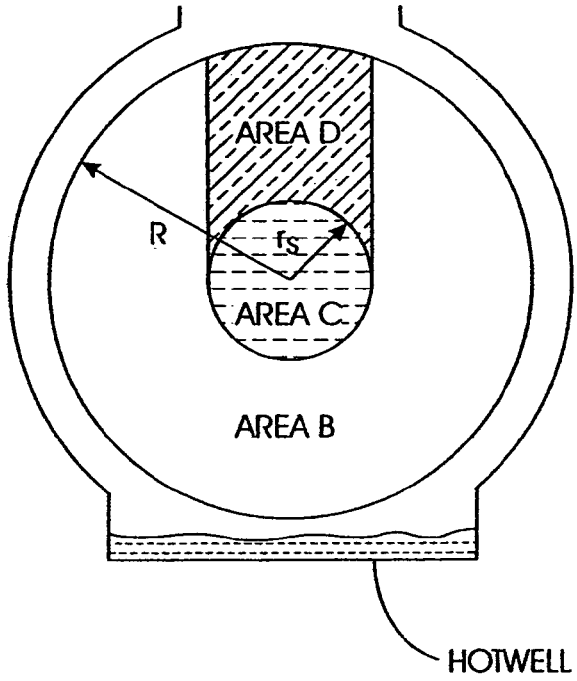
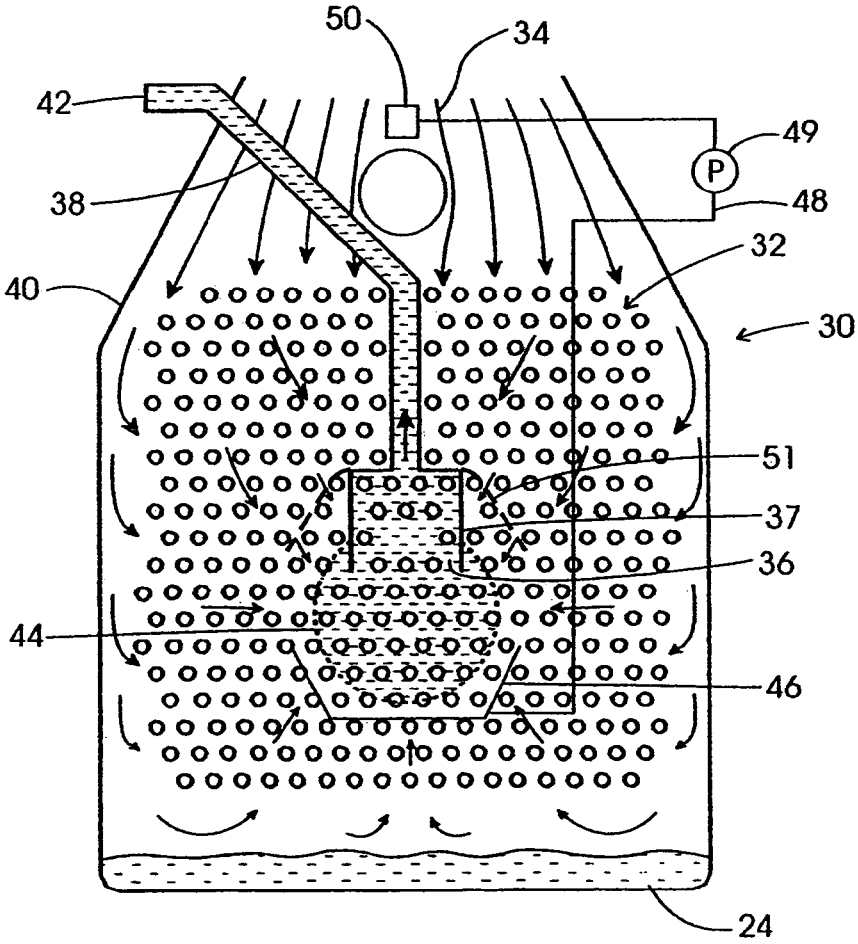
FIG. 9

CONDENSERS AND THEIR MONITORING

CROSS-REFERENCE TO RELATED APPLICATION

This application is a division of prior application Ser. No. 10/703,850, filed Nov. 7, 2003, which claims priority on PCT/US02/12038, filed Apr. 16, 2002, the disclosure of which is hereby incorporated by reference.

BACKGROUND OF THE INVENTION

The invention presents the description of a new measurement based model that provides the basis for a theoretical description of the behavior of a power plant steam surface condenser performance under the influence of air in-leakage. The measurement is a quantification of properties of the water vapor and non-condensable gas mixture flowing in the vent line between the condenser and the exhauster. These properties are used, along with condenser measurements and operating conditions, to identify gas mixture properties inside the condenser. This model then is used to predict important condenser performance and behavior, which is compared to plant measurements and observations to confirm model validity. The measurement is shown to be compatible with requirements for modern power plant information systems supporting O & M, plant life, asset management and predictive maintenance. Innovative design modifications of present condenser systems and new systems and measurements are anticipated.

In 1963, Professor R. S. Silver (R. S. Silver, "An Approach to a General Theory of Surface Condensers", *Proceedings of the Institution of Mechanical Engineers*, Vol. 178 Pt 1, No. 14, London, pp. 339-376, 1963-64) published a stimulating paper dealing with the general theory of surface condensers, wherein it was stated that, "It is well known to all operators and designers of condensing plants that the presence of a small proportion of air in the vapor can reduce the heat transfer performance in a marked manner." In a recent publication by EPRI (R. E. Putman, *Condenser In-Leakage Guideline*, EPRI, TR-112819, January, 2000) on the effects of air ingress, it is stated, " . . . but the presence of even small amounts of air or other non-condensables in the shell space can cause a significant reduction in the effective heat transfer coefficient." In effect, for thirty-eight years, this understanding has remained entrenched and unchanged. In neither of these publications, nor any other publication or known paper, has a quantifiable amount of air in-leakage into an operating condenser resulted in a measured change in condenser performance that can be defined by a comprehensive theoretical treatment in support of these statements.

The currently accepted description of a condenser and the formulas for determining its performance are discussed below. The illustration in FIG. 1 represents the temperature profile of cooling water passing through tubes in a condenser. The following abbreviations apply to FIG. 1 and are used herein:

$T_{HW}$ is the hotwell temperature, ° F.;
$T_v$ is the vapor temperature, which can be set equal to the hotwell temperature $T_{HW}$, ° F.;
$T_{cw1}$ and $T_{cw2}$ are the inlet and outlet circulating water temperatures, respectively, ° F.;
TTD is the terminal temperature difference, ° F.;
$\Delta T_{cw}$ is the rise in circulating water temperature, ° F.;
$\Delta T_{lm}$ is the Grashof logarithmic mean temperature difference, which is the mean temperature driving force for heat flow between the exhaust steam vapor and cooling water in the condenser tubes, ° F.;
$d_t$ is the tube bundle density, tubes/ft$^3$;
$\dot{m}_r$ is steam mass flow rate at r, lb/hr;
$\dot{m}_{r,a}$ is the steam & air mass flow rate at r, lb/hr;
$\dot{m}_{t\ a}$ is the steam mass flow rate per tube, lb/hr;
$\dot{m}_{T\ a}$ is the total steam mass flow rate, lb/hr;
$n_a$ is the number of tubes in condenser;
$n_a$ is the number of active tubes in condenser;
$p_a$ is the air partial pressure, "HgA;
$p_i$ is the partial pressure of i$^{th}$ gas, atmospheres;
$p_o$ is the oxygen partial pressure, atmospheres;
$p_s$ is the steam partial pressure, "HgA;
$P_T$ is the condenser pressure, "HgA;
$p_v$ is the water vapor partial pressure, "HgA;
r is the radius in tube bundle, ft;
$r_s$ is the stagnant zone radius, ft;
$v_r$ is the steam velocity at radius r, ft/sec;
$v_{r,a}$ is the steam & air velocity at radius r, ft/sec;
AIL is the Air In-leakage, SCFM;
$H_i$ is Henry's law constant for the i$^{th}$ gas, mole ratio/atmosphere;
L is the tube length, ft;
PPB is parts per billion, mole ratio;
R is the tube bundle diameter, ft;
SCF is standard cubic feet;
SCFM is standard cubic feet per minute; and
$O_l$ is the solubility of the of the i$^{th}$ gas, mole ratio.

The relationship between $\Delta T_{lm}$ and other variables in FIG. 1 (in which all temperatures are in ° F.) is as follows:

$$\Delta T_{lm} = \frac{T_{cw2} - T_{cw1}}{\ln\left(\frac{T_v - T_{cw1}}{T_v - T_{cw2}}\right)} \quad \text{Eq. 1}$$

Equation 1 in turn can be written as:

$$\Delta T_{lm} = \frac{\Delta T_{cw}}{\ln\left(1 + \frac{\Delta T_{cw}}{TTD}\right)} \quad \text{Eq. 2}$$

Since $\Delta T_{cw}$ is due to a steam load, Q (BTU/hr), from the turbine requiring energy removal sufficient to convert it to condensate, one also can write the following equations:

$$Q = \dot{m}_{cw} c_p \Delta T_{cw} \text{ (Heat load to the circulating water)} \quad \text{Eq. 3}$$

and, $$Q = \dot{m}_s h_{fg} \text{ (Heat load from steam condensation)} \quad \text{Eq. 4}$$

where, $\dot{m}_{cw}$ (lbs/hr) is the mass flow rate of circulating water,
$c_p$ (BTU/lb·° F.) the specific heat of water,
$\dot{m}_s$ (lbs/hr) the mass flow rate of steam, and
$h_{fg}$ (BTU/lb) the enthalpy change (latent heat of vaporization).

Combining Equations 3 and 4, yields the following equation:

$$\Delta T_{cw} = \frac{\dot{m}_s h_{fg}}{\dot{m}_{cw} c_p} \quad \text{Eq. 5}$$

which defines the rise in circulating water temperature in terms of mass ratio of steam flow to circulating water flow and two identifiable properties. Consistent with good engineering heat transfer practice in describing heat exchangers, Q is related to the exposed heat transfer surface area A, and $\Delta T_{lm}$, with a proportionality factor characteristically called the heat transfer coefficient, U. This relationship is given by:

$$Q=UA\Delta T_{lm} \quad \text{Eq.6}$$

Combining equation (6) with equations (2) and (3), yields the following equation:

$$\dot{m}_{cw} = \frac{UA}{c_p \ln\left(1 + \frac{\Delta T_{cw}}{TTD}\right)} \quad \text{Eq. 7}$$

which, following rearrangement, becomes:

$$TTD = \frac{\Delta T_{cw}}{\left(e^{\left(\frac{UA}{\dot{m}_{cw} c_p}\right)} - 1\right)} \quad \text{Eq. 8}$$

Since $c_p$ is constant, $\dot{m}_{cw}$ and $\Delta T_{cw}$ held constant through a fixed load Q, and with A assumed constant, the terminal temperature difference becomes only a function of U, or:

$$TTD=f(U) \quad \text{Eq.9}$$

The theory goes on to say that the thermal resistance R, the inverse of U, can be described as the sum of all resistances in the path of heat flow from the steam to the circulating water, given by:

$$R = \frac{1}{U} = R_a + R_c + R_t + R_f + R_w \quad \text{Eq. 10}$$

where, a is air;

c is condensate on tubes;

t is tube;

f is fouling and w is circulating water.

Historically, much effort has gone into analytically describing each of these series resistances. The best characterized are $R_w$, $R_f$, and $R_t$. Values of $R_c$, dealing with condensate on the tubes, have gained a lot of attention with some success; and $R_a$ essentially has been ignored with the exception of near equilibrium diffusion limited experimental measurements and its associated theory (C. L. Henderson, et al., "Film Condensation in the Presence of a Non-Condensable Gas", *Journal of Heat Transfer*, Vol. 91, pp. 447-450, August 1969). The latter generally is believed to be very complex (see Silver and Putman, supra) and limited data is available. The general belief is that small amounts of air will dramatically affect the heat transfer coefficient, resulting in an increase in the values of $\Delta T_{lm}$, TTD, and $T_{HW}$, without analytical description. The importance to the invention resides in part in that $R_a$ is assumed to be treatable in a manner similar to tube fouling, as shown in Equation 10.

Deficiencies of the Current Condenser Model

To examine the validity of the existing model, tests can be conducted. It should be expected that if a large number of power plant steam turbine condensers were tested under a normalized or similar condition, a common agreement or trend would exist in the measured heat transfer coefficient. These tests would confirm the usefulness of Equations 2 and 6 in describing performance of given condensers. Gray (J. L. Gray, *Discussion*, pp. 358-359; Silver supra) reports the determined heat transfer coefficients, using Equation 6, versus circulating water tube velocity for many clean tube condensers normalized to 60° F. inlet circulating water. These data are shown in FIG. 2. According to the theory, all data should lie scattered about a neat curve as shown by Heat Exchange Institute (HEI) (*Standards for Steam Surface Condensers*, HEI, Eighth Edition, p. 9, 1984). Gray's data show that this is not the case; he concluded that the measured variation indicates the need for an improved design basis. The degree of disagreement goes far beyond the subtle modification coefficients discussed elsewhere, (see Putman and HEI, both supra), which is the subject of modern theoretical endeavor.

Q is a measurable quantity and its value is relatively easy to ascertain. $\Delta T_{lm}$ on the other hand is not so easy to determine. Investigators assume that it is the same for each tube in the condenser. For this to be the case, however, all tubes must have the same flow rate, equal (or no) internal fouling, and identical environments on the shell side. However, an overwhelming amount of data is available showing that this is not the case. Discharge temperature in the outlet water box may be non-uniform and tube exit temperatures vary as much as 10° F. or more over large areas even though flow rate in each tube is the same. Work by Bell (R. J. Bell, et al., "Investigation of Condenser Deficiencies Utilizing State-of-the-Art Test Instrumentation and Modeling Techniques," Private communication) shows 20° F. variations, which he attributes to "air binding." The use of an overall average value of $\Delta T_{cw}$, should, however, be in proportion to Q. But, this does not guarantee that the form of Equation 2, 6, or 8 in determining the heat transfer coefficient value is valid.

Evaluators use the total tube surface area for the value of A in Equation 6. The form of Equation 6, however, reflects a different understanding for A. In this equation, A has the meaning that it is the useful area participating effectively as a heat exchange surface. That would include condensate on the tube surface and subcooled condensate drops or streams, in transit under the force of gravity, in the space between tubes. If any portion of the condenser is not involved significantly in condensing steam, and its numerical value is known, then the physical tube surface area A may be the wrong value to use in determining the active condenser heat transfer coefficient. The air binding, cited above, is an example. If the effects of air on U are not considered properly, then the effects of tube fouling on condenser performance becomes questionable.

Another limitation of the model is the lack of understanding of air in-leakage behavior within the shell side of the condenser. Instead of a "little amount of air affecting condenser performance," measurements show that as long as the air in-leakage is below the capacity of air removal equipment to remove air at a suction pressure compatible with the no air hotwell temperature equilibrium pressure, no excess turbine backpressure is experienced (J. W. Harpster, et al., "Turbine Exhaust Excess Backpressure Reduction." *FOMIS* 38$^{th}$ *Semi-annual Conference—Optimizing Station Performance*, Clearwater Beach, Fla., Jun. 7-10, 1999). Very high air in-leakage can be prevented from affecting condenser performance simply by adding more exhausters. This means that the model developed, which shows air converging on tubes by virtue of scavenging by radially directed condensing vapor, is not valid throughout the condenser as some researchers may believe.

Further, when air in-leakage exceeds the capacity of the exhausters, the pressure begins to rise above an observed no air saturation level. Under these conditions, condenser performance is known to be adversely affected. Following from Equations 6, 9, and 10, the value of TTD should increase causing a rise in the $T_v$, and a subsequent rise in hotwell temperature. In-plant measurements, however, do not always support a rise in hotwell temperature resulting from air in-leakage induced excess backpressure (see Harpster, id). This condition can sometimes be referred to as condensate subcooling. Added excess backpressure often appears as an air partial pressure above that of the hotwell temperature-driven water saturation vapor partial pressure. Further, there is no analytical description for the condenser pressure saturation response at low air in-leakage.

BRIEF SUMMARY OF THE INVENTION

The importance of advanced instrumentation to directly measure assumed or unknown subsystem properties or characteristics of power plants, operating within the current market, is disclosed. These measurements are needed to quantify critical parameters, not only in power generation units with older control hardware, but also for those equipped with modern information systems, which may or may not contain simulation computations, for plant control and management. One such measurement is air in-leakage into the shell side of a steam surface condenser. This measurement, along with an understanding of its response to behavior of steam and non-condensables within the condenser space, forms one aspect of the present invention. This understanding provides the foundation for a comprehensive theoretical treatment of how air behaves in a condenser, and its effect on condenser performance.

The use of air in-leakage and condenser diagnostic instrumentation or multi-sensor probe (RheoVac® instrument, Intek, Inc., Westerville, Ohio) provides the ability to measure properties of the gases entering the vent line from the air removal section of a condenser. It will be shown that these data, along with other condenser operating parameters, can be combined to describe air passage within the condenser. Also described are the performance characteristics of the condenser as they are affected at different levels of air ingress. The impact of air in-leakage on excessive subcooling, resulting in high dissolved oxygen, will be presented. A practical control point for maintaining air in-leakage in operating plants will be disclosed from the viewpoint of minimizing dissolved oxygen and improving heat rate. A summary description of the functional manner in which the RheoVac® instruments compute gas properties is provided since some important measurement data useful for power plant control and diagnostics derived by this instrument can now be made possible as a result of the model described in this application. It is now possible to use a temperature sensor at a new location, or a temperature sensor and a relative saturation sensor at another new location, to detect a condenser related source of excess backpressure (along with other normal plant measurements), by measuring the amount of subcooling at the exit of the air removal section.

Disclosed, then, is a method for operating a condenser of the type having a housing inside of which is disposed a bundle of circulating water tubes, a steam inlet allowing steam to flow inside the housing and contacting the tube bundle to reduce the steam to condensate, and the generation during operation of a stagnant air zone containing significant amount of air, wherein some air in-leakage can preferentially collect and remaining water vapor in the air zone becomes subcooled. A trough or drain is placed beneath the stagnant air zone for collecting subcooled condensate generated there or falling through the stagnant air zone from above, unless otherwise diverted, and becoming high in dissolved oxygen concentration while transiting through this high air region. A trough or drain transports collected subcooled condensate to a pipe to said steam inlet, preferably using a pump. The transported condensate is injected with an injector (spray device) for contacting with steam entering the condenser, whereby the injected condensate is heated by the steam for expelling dissolved oxygen in the injected condensate. Other means of reducing dissolved oxygen in condensate is also made clear. Advantageously, the outlet end of the tubes of the condenser is fitted with an array of temperature sensors extending through the expected stagnant air zone for direct measurement of its presence and/or size. Often this requires the entire tube bundle to be fitted with said array of temperature sensors. A calibration of the condenser using a RheoVac® instrument may also be used to determine the extent of the stagnant zone.

Disclosed further, is a second condenser having the tube surface area of the size of the stagnant zone tube area, above, where noncondensable gases along with steam can enter from a smaller first condenser, which is devoid of a stagnant zone, for subcooling to take place and where condensate having a high concentration of oxygen can be collected and returned as spray in the steam entrance flow of the smaller first condenser.

Disclosed additionally is a temperature sensor located at the beginning of a vent line leaving a condenser for the purpose of making one of two measurements needed to determine the amount of subcooling in the condenser, to enable the determination of the number of tubes which have essentially lost their ability to condense steam due to buildup of air as a result of air in-leakage (or other non-condensables) in the condenser, Disclosed further is a temperature sensor and a relative saturation sensor, located in the vent line after leaving the shell space of the condenser, which, if the gas therein was excessively subcooled before entering the vent line and subsequently becomes heated, while passing through the vent line, by the condensing steam, can now be used to determine the amount of subcooling at the vent inlet when compared to the condenser steam vapor temperature, thus determining the effect on the condenser by air buildup in the condenser as above.

It will be appreciated that other processes utilize process fluid vapors, e.g., solvents, which require drying and recovery and which processes utilize condensers that operate at internal sub-atmospheric pressures. Such process solvent operations, then, can benefit from the present teachings regarding the operation of sub-atmospheric condensers. For convenience and by way of illustration, and not by way of limitation, the present invention will be described in connection with the condensation of steam, particularly from power plants; although, it should be recognized that any condensable vaporous solvent could be condensed in accordance with the precepts of the present invention. The same is true of the condensing medium, which most often is water, but can be air or any other suitable heat exchange medium.

BRIEF DESCRIPTION OF THE DRAWINGS

For a fuller understanding of the nature and advantages of the present invention, reference should be made to the following detailed description taken in connection with the accompanying drawings, in which:

FIGS. 3A and 3B is a simplified representation of a RheoVac® Multi-sensor Air In-Leakage Instrument, which was used to take condenser measurements reported below;

FIG. 4 is a simplified cut-away section view perpendicular to the tube bundle length of an ideal condenser, having no entrapped air, fitted with a steam inlet, water tube bundle, and hotwell for condensate collection;

FIG. 8 is the condenser of FIG. 6 for the case when one-third of the water tubes are disposed in the stagnant air pocket and significantly not condensing much steam;

FIG. 9 is a simplified cut-away elevational view of a condenser fitted with an air removal section and stagnant air zone with exhauster assembly extraction line;

Figure 1:
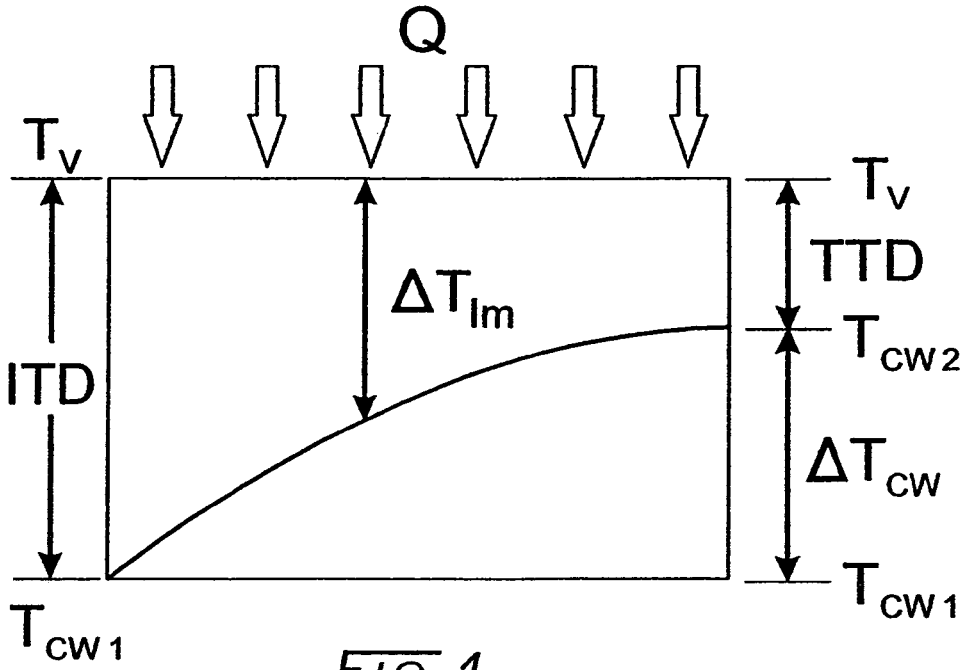
FIG. 1 represents the temperature profile of cooling water passing through tubes in a condenser.
Figure 2:
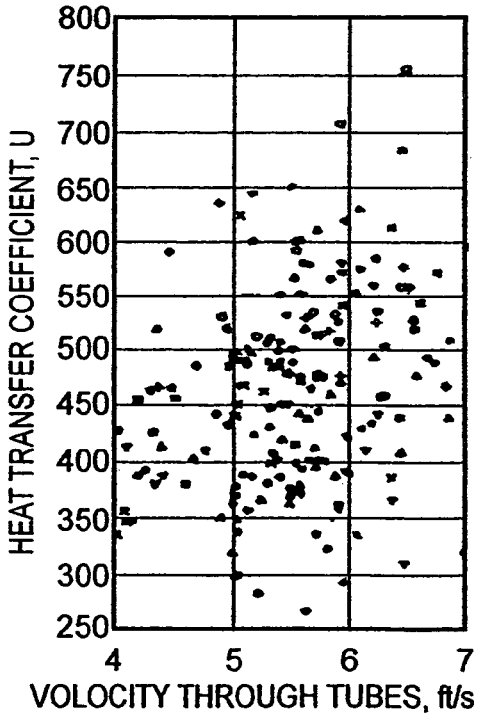
FIG. 2 shows experimental graphical plots of the determined heat transfer coefficients, as may be determined using Equation 6, versus circulating water tube velocity for many clean tube condensers normalized to 60° F. inlet circulating water, as reported by Gray, supra.

The drawings will be described in more detail below.

DETAILED DESCRIPTION OF THE INVENTION

Condenser Measurements

Measurements of air in-leakage in steam surface condensers have been performed using a patented multi-sensor probe (Putman, supra; U.S. Pat. Nos. 5,485,754 and 5,752,411; Rheotherm® Flow Instruments and RheoVac® Multi-sensor Air In-Leakage Instruments, Intek, Inc., Westerville, Ohio 43082) since 1994. This measurement is made in the exhauster vent line at a convenient location between the condenser shell and the exhauster suction port. There are four measurements made on the flowing gases along with reasonable assumptions regarding its composition that permit quantifying the mass flow rate of the gas mixture constituents. It is assumed that the mixture is composed of water vapor and air. All non-condensables being removed from the condenser are included in the measured amount of air.

The probe, 10, (RheoVac® Multi-sensor Air In-Leakage Instrument), shown in FIG. 3, consists of a dual probe thermal flow sensor, 12, a temperature sensor, 14, that also is used as the flow sensor reference, a pressure sensor port, 16, and a sensor port, 18, to measure the relative saturation of the water vapor component. A microprocessor based electronics package (not shown) provides for mathematical manipulations of thermodynamic equations describing the gas mixture to separate the total mass flow rate of the gases into the two identified components. In doing so, various properties are computed: air flow in-leak, total mass flow, water vapor flow, water partial pressure, actual volume flow, relative saturation, water vapor specific volume, water to air mass ratio, temperature, and pressure. The usefulness of these parameters have been discussed in several publications (Putman, Harpster, both supra; F. Maner, et al., "Performance Enhancement with Remote Monitoring of Condenser Air In-Leak" *Power-Gen '99 Americas Conference Proceedings*; F. Maner, et al., "Performance Improvements based on Measurement and Management of Air In-Leak" 1999 *EPRI Condenser Technology Conference*, Charleston, S.C., Aug. 30-31, 1999) special focus is directed to the water-to-air mass ratio (Harpster, supra) because of its generally clear indication for relating the threshold of air in-leakage to the onset of excess condenser backpressure.

The instrument accuracy for measuring air in-leakage is about 1 SCFM with a precision of 0.1 SCFM when calibrated for a wide dynamic range. It was this instrument that allowed well-defined property measurements of gas in the vent line to permit precise quantification of subcooling within the condenser subsections and the identification of gas dynamics inside the condenser described herein.

Basic Condenser Model

Model with No Air

To understand the behavior of a condenser under the influence of air ingress, one must first understand its behavior without air, and other non-condensable gases. This view permits the luxury of examining a very simple hypothetical configuration without the complexity of obstructions and an air removal section (ARS).

This hypothetical condenser, 20, is shown in FIG. 4. It would be a somewhat practical design if there were no air in-leakage or if there was no production of other non-condensable gases developed in the water and steam cycle, since all of the load could be condensed and a vacuum maintained. Assume a hexagonal patterned, obstruction-free, tube bundle, 22, of radius R=12.37 ft, containing $n_t$=20,272 tubes (not all shown) of 1 inch outside diameter, 22 ga wall, located on 2 inch centers, and each tube length L=68 feet. The density of tubes, $d_t$, in the tube bundle becomes 42.16 tubes/ft$^2$.

Assume further that circulating cooling water flow and applied load having a steam mass flow rate, 26, of $\dot{m}_s=2.4441\times10^6$ lbs/hr, results in a hotwell temperature, $T_{HW}$, in the hotwell, 24, of 108° F. and a turbine exhaust steam backpressure P=2.45" HgA. Since it is common to expect the same circulating water outlet temperature for each tube, one can say without apology that each tube is responsible for condensing the same amount of steam at a rate given by:

$$\dot{m}_t = \frac{2.4441\times10^6}{20{,}272} = 120.56 \text{ lb/}hr \qquad \text{Eq. 11}$$

For the purpose of gaining insight from this hypothetic condenser, inundation of the lower tubes has been ignored, i.e., condensate falling from above and filling the space between the tubes and shutting off the ability of steam to reach these bottom tubes.

We may further assume that the steam flow is distributed such that the velocity of the steam toward the tube bundle outer boundary area, a, is uniform over this total surface region and is radially directed inward. This velocity is given by:

$$v_R = \frac{\dot{m}_s}{(\rho_s a)} = 36.0 \text{ ft/sec} \qquad \text{Eq. 12}$$

where the steam density $\rho_s$ is the inverse of the specific volume of entering steam, 26, at the temperature of 108° F. For a familiar reference to all readers, this velocity is equivalent numerically to a speed of 24.6 mph, for this condenser.

To see how this velocity changes throughout the bundle, one first examines the inward directed mass flow rate as a function of radial distance. The number of tubes, $n_r$, that exist inside the cylindrical area described by radius, r, is the product of this area and the tube bundle density, $d_t$, given by: $n_r=\pi r^2 d_t$. The portion of steam mass flow, 26, reaching radius r, $\dot{m}_r$, then is simply $n_r$, multiplied by the mass flow rate per tube, from Equation 11, given by:

$$\dot{m}_r=\pi\dot{m}_t d_t r^2 \qquad \text{Eq. 13}$$

The steam velocity dependence on radial distance, then, is given by Equation 13 divided by steam density and the cylindrical surface area of the tube bundle confining the tubes within radius, r, or:

$$v_r = \frac{\dot{m}_t d_t r}{2\rho L} \qquad \text{Eq. 14}$$

Figure 5A:
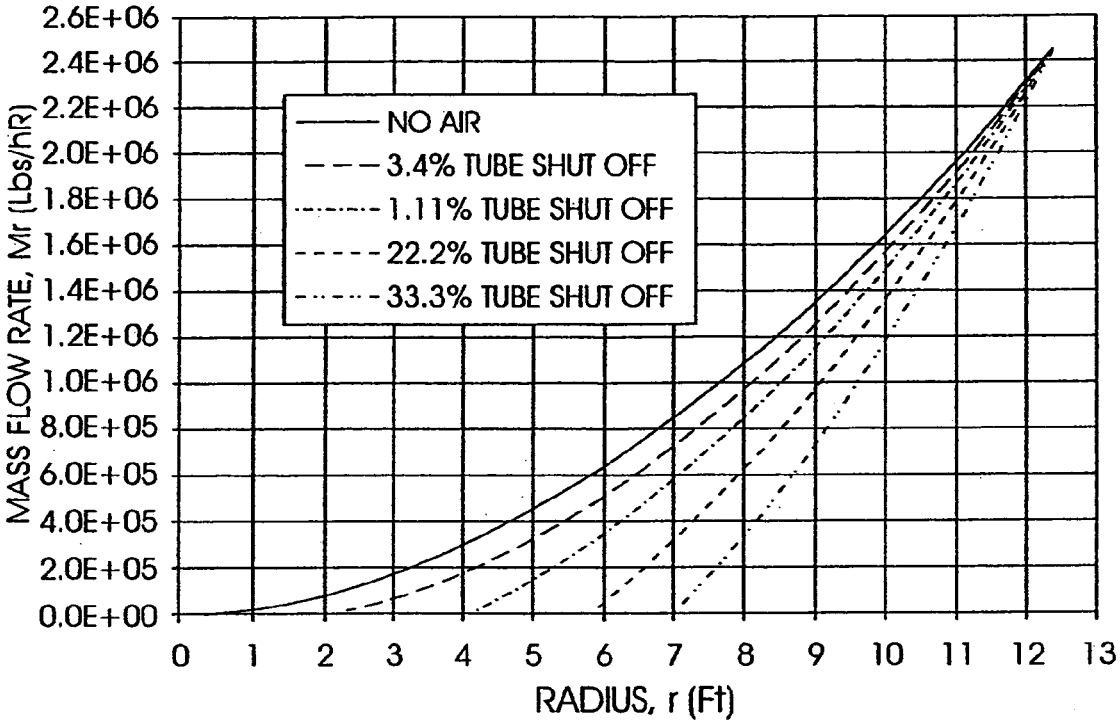
FIG. 5A is a graphical plot of a radial mass flow rate of steam versus tube bundle radius for a condenser operating with active cooling water tubes and steam input, with and without air present.
Figure 5B:
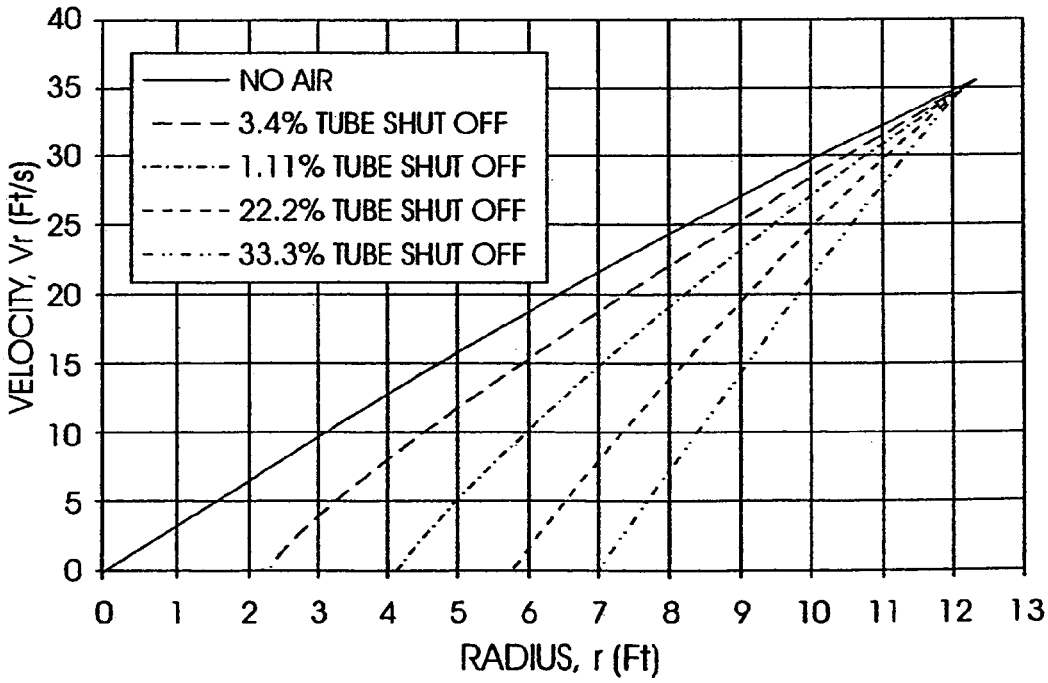
FIG. 5B is a graphical plot of radial velocity versus condenser tube radius for a condenser operating with active cooling water tubes and steam input, with and without air present.

Equation 14 shows that, for the geometry considered, the radial velocity is directly proportional to the radial distance going to zero at the geometric center of the tube bundle. The solid line in FIGS. 5A and 5B shows the radial distribution of mass flow rate and velocity of steam for the ideal no air condenser (along with other cases to be discussed later).

Recall that the hotwell temperature is $T_{HW}$=108° F. and each tube has a condensation rate of $\dot{m}_t$=120.56 lbs/hr. An acceptable assumed value for the circulation water velocity is $v_{cw}$=6.33 ft/sec. One also may assume an inlet circulating water temperature of $T_{cw1}$=85° F. Note also that the total condensing surface area, A, is 360,889 ft$^2$ derived from tube geometry and defined values, and that the surface area of each tube is $A_t$=17.8 ft$^2$.

To solve for the heat transfer coefficient U, the circulating water mass flow rate $\dot{m}_{cw}$ first must be calculated using the inner tube cross sectional area $a_t$=0.00486 ft$^2$, water density ρ, and the above flow velocity $v_{cw}$, giving $\dot{m}_{cw}=\rho\, v_{cw}\, a_t$=6,909 lbs/hr/tube or 279,889 GPM/condenser. Now, using Equation 5 and an enthalpy value $h_{fg}$ of 1032.5 for $T_{HW}=T_v$=108° F., then $\Delta T_{cw}$=18.024° F. Knowing that $TTD=T_v-\Delta T_{cw}-T_{cw1}$, we obtain TTD=4.98° F. From Equation 2, $\Delta T_{lm}$=11.78° F. Finally, using Equation 6, we can solve for U, obtaining a value of 593.8 BTU/(ft$^2$×hr×° F.). Since all tubes in the condenser act the same, the values of U and $\Delta T_{lm}$ for the whole condenser are the same numerical values for each individual tube. This assumption, of course ignores the cold tubes located in the stagnant zone.

The performance parameters and operating conditions discussed above are summarized as Case 1 in Table 1. If there were no air in-leakage or other non-condensables entering the shell space of this condenser, it would be a suitable design for 535 MW generating unit. Table 2, below, summarizes the same data, except that the cold water in the tubes located in the stagnant zone are ignored in determining the average exit tube water temperature and only the temperature of the active tubes is taken into account.

TABLE I

Summary of Hypothetical Condenser Performance

| Case # | % tubes lost | $T_s$ (° F.) | Pressure ("HgA) | Active Area Circulating Water Out (° F.) | Condensate per Active Tube (lbs/hr) | Active TTD (° F.) | Active $\Delta T_{lm}$ (° F.) | Apparent Heat Transfer Coefficient $\left(\frac{\text{BTU}}{\text{ft}^2\times\text{Hr}\times{}^\circ\text{F.}}\right)$ | Coefficient (η) |
|---|---|---|---|---|---|---|---|---|---|
| 1 | 0 | 108.00 | 2.450 | 103.02 | 120.56 | 4.980 | 11.78 | 593.80 | 1.000 |
| 2 | 2 | 108.46 | 2.483 | 103.35 | 123.03 | 5.442 | 12.33 | 567.01 | 0.955 |
| 3 | 6 | 109.45 | 2.556 | 104.15 | 128.26 | 6.432 | 13.49 | 517.95 | 0.873 |
| 4 | 11.1 | 110.84 | 2.660 | 105.24 | 135.62 | 7.822 | 15.08 | 462.98 | 0.780 |
| 5 | 22.2 | 114.45 | 2.950 | 108.08 | 154.97 | 10.980 | 18.56 | 375.40 | 0.632 |
| 6 | 33.3 | 119.25 | 3.376 | 111.84 | 180.76 | 16.232 | 24.13 | 287.96 | 0.485 |

Constants: $T_{HW}$ = 108° F.; U (active tubes) = 593.8 BTU/(ft$^2$ × Hr × ° F.); $T_{cw2}$ (average) = 103.2° F.

TABLE 2

Summary of Hypothetical Condenser Performance

| Case # | % tubes lost | $T_s$ (° F.) | Pressure ("HgA) | $T_{cw}$ Active Tubes (° F.) | $T_{cw2}$ Active Area (° F.) | Active TTD* (° F.) | Active $\Delta T_{lm}$ (° F.) | Apparent Heat Transfer Coefficient $\left(\frac{BTU}{ft^2 \times Hr \times ° F.}\right)$ | Coefficient (η) |
|---|---|---|---|---|---|---|---|---|---|
| 1 | 0 | 108.00 | 2.450 | 18.016 | 103.023 | 4.977 | 11.77 | 594 | 1.000 |
| 2 | 2 | 108.46 | 2.483 | 18.386 | 103.386 | 5.074 | 12.08 | 582 | 0.98 |
| 3 | 6 | 109.45 | 2.556 | 19.159 | 104.159 | 5.291 | 12.52 | 558 | 0.94 |
| 4 | 11.1 | 110.84 | 2.660 | 20.242 | 105.212 | 5.598 | 13.23 | 528 | 0.89 |
| 5 | 22.2 | 114.45 | 2.950 | 23.083 | 108.083 | 6.367 | 15.07 | 462 | 0.78 |
| 6 | 33.3 | 119.25 | 3.376 | 26.854 | 111.854 | 7.396 | 17.52 | 396 | 0.67 |

*From $T_{cw2}$ in the Active Region

Model with an Amount of Air

Figure 6:
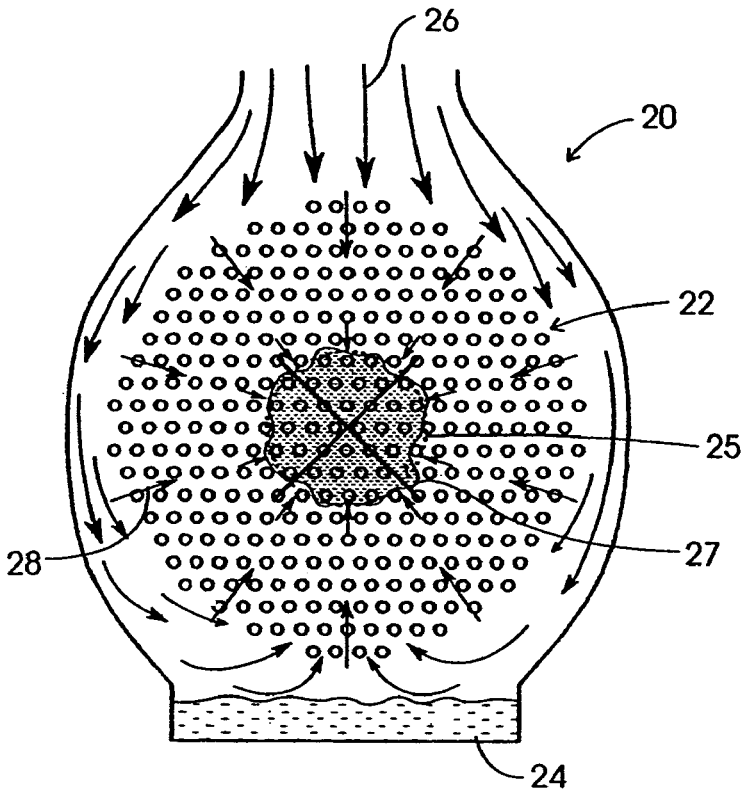
FIG. 6 is the simplified condenser of FIG. 4 with an amount of injected air, which has become concentrated within a central stagnant air zone.

Consider now what happens if an amount of air is injected into this condenser. It should be obvious that the high speed of the radially directed steam will carry (scavenge) the air toward the center of the condenser where it will accumulate, as shown in FIG. 6 as region 25. Since the total pressure in central region 25 is essentially that of the condenser or incoming steam at region 26, an equilibrium is established between the air and water vapor such that the sum of their partial pressures is equal to the condenser pressure. This demands a drop in water vapor pressure with a consequential drop in its temperature. The only way for the temperature to be reduced is to slow the rate of condensation on these tubes allowing the circulating water temperature rise per unit length to be lower throughout this tube bundle region. The lack of heat transfer from condensing steam due to the presence of air is the cause for the region to drop in temperature, and results, locally, in condensate "subcooling". It is these tubes in region 25 of condenser 20 that behave in a manner described elsewhere in the literature (see Henderson, supra), but generally thought to prevail throughout the whole of the condenser. Air cannot exist and does not exist in a concentrated form around tubes in the steam rich, high velocity region outside central region 25 of condenser tube bundle 22.

It is not unexpected that this region would contain a very low mass ratio of water vapor to air. Henderson and Marchello, supra, showed in single tube experiments that the ratio of measured heat transfer coefficient with air present, on a condensing tube, to the heat transfer coefficient with no air, plotted against mole percent of non-condensable air in vapor was dramatic, giving rise to the general belief that the presence of even a small amount of air or other non-condensable in the shell space of a condenser can cause a significant reduction in the effective heat transfer coefficient. Their obtained laboratory data, originally shown as mole percent dependence, is presented in FIG. 7, modified to show with high resolution the corresponding water-to-air mass ratio.

It has been shown from tests in many plants, for a water vapor to air mass ratio of less than about 3 measured in the exhauster line, that the exhauster backpressure will rise (see Harpster, supra). From FIG. 7 the heat transfer coefficient for this mixture is reduced to 10% of its no air value. For purposes of illustrating the model, one can assume there is no condensation in a region with a water vapor to air mass ratio of ≦ about 3. This allows us to define a few useful terms. The outside region having high vapor concentration of condensing steam and relatively high velocities may be called the "Steam Wind" region, e.g., as at numeral 28. The air-enriched area is identified as the "Stagnant" region, 25, as velocities can be near zero since, in this region, there is only a small amount of condensing steam driving the velocity. Practically speaking, there is no sharp demarcation line between these two regions, as may be explained by thermodynamics of concentration gradients.

Returning to the above, one can assume the amount of air is sufficient to effectively eliminate condensation on all centrally located tubes inside the space defined by one third the tube bundle radius, or 11.1% of all tubes are removed from service. To observe the effect on excess backpressure and vapor temperature, we proceed essentially as before. The steam load will remain the same; but, since the number of active tubes are reduced to 18,022, we have from Equation 11: $\dot{m}_t$=135.6 lbs/hr, which is the steam mass flow rate per tube for each tube in the Steam Wind region of the condenser.

To determine the new equilibrium condenser steam temperature and corresponding condenser pressure, one first assumes a new vapor temperature of 110° F. from which the corresponding $h_{fg}$ (enthalpy) value of 1031.4 BTU/lb is obtained. The new circulating water temperature rise, at the same flow rate as before, across the tube length for each active tube is found from Equation 5 to be:

$$\frac{\Delta T_{cw}}{\text{tube}} = \frac{(135.6 \times 1031.4)}{1 \times 6909.12} = 20.25° \text{ F.} \qquad \text{Eq. 15}$$

The value for $\Delta T_{lm}$ can be obtained from Equation 6 on a per tube basis, using the above no-air heat transfer coefficient, as:

$$\Delta T_{lm} = \frac{135.6 \times 1031.4}{593.8 \times 17.8} = 13.2 \text{ °F} \qquad \text{Eq. 16}$$

and the terminal temperature difference, on a per tube basis, is found from Equation 2 to be:

$$TTD = \frac{\Delta T_{cw}}{\left(e^{\frac{\Delta T_{cw}}{\Delta T_{lm}}} - 1\right)} = 5.59 \text{ °F} \qquad \text{Eq. 17}$$

from which $T_v$=3285+20.25+5.59=110.84° F., which is sufficiently close to the assumed 110° F. that iteration is not needed. The resulting condenser pressure becomes $\rho_v$=2.660" HgA, giving an excess backpressure of 2.660"−2.450"=0.210" HgA, caused by the presence of air.

Assuming this space in the stagnant zone is only 6° F. subcooled (but keeping in mind that since the region is assumed to have no steam condensation, it could therefore reach in the limit, the temperature of the inlet circulating water). The water vapor pressure in this region is dictated by the temperature of 110.84°−6.0°=104.84° F., which is 2.233" HgA having a density of 0.00326 lb/ft$^3$. The air partial pressure, therefore, must be 2.660"−2.233"=0.427" HgA for this region to be in equilibrium with the remainder of the condenser. From the well known relationship:

$$\rho_v/\rho_a=0.622p_v/p_a \quad \text{Eq. 18}$$

the mass ratio is determined as $\dot{m}_v/\dot{m}_a=\rho_v/\rho_a=0.622(2.233/0.427)=3.25$, in agreement with the desire to have negligible heat transfer.

The gas space volume of the stagnant zone, $V_{sz}$, is given by:

$$V_{sz}=\left(\pi\left(\frac{12.37}{3}\right)^2\times 68\right)-\left(2250\times\pi\left(\frac{1}{12}\right)^2\times 68\right)=2797.6\ \text{ft}^3 \quad \text{Eq. 19}$$

where the second term is the volume taken up by the enclosed tubes. As a consequence of Equation 19, with a mass ratio of 3 and the stated water vapor density, the total mass of air in $V_{sz}$ becomes $m_a$=2797.6×1/3×0.00327=3.05 lbs. This condition is realized with 40.7 standard cubic feet of air inserted into the condenser.

Should, however, this vapor space fall to within 2° F. of the inlet circulation water temperature, or 87° F., $p_v$=1.293" HgA with: $\rho_v$ (87° F.)=1/511.9=0.00195 and $\rho_a$=2.660−1.293=1.367, where from Equation 18, $$\rho_a=\frac{\rho_v p_a}{0.622\,p_v}=0.00331,\quad \text{giving}$$

$$\frac{\dot{m}_v}{\dot{m}_a}=\frac{0.000195}{0.00331}=0.58\ \text{and,}$$

$$\dot{m}_a=2797.6\times .00331=9.3\ \text{lb.}$$

At this lower temperature the stagnant zone would contain 124 standard cubic feet of air. It should be noted that the region is effectively eliminated from the overall condensation process regardless of the amount of subcooling below 6° F., but the amount of air to isolate the region is a function of the amount of subcooling. It is anticipated that the degree of subcooling will be a function of the stagnant zone size and gas dynamics.

Using methods similar to the development of Equations 13 and 14, with $r_s$ being the radius of the stagnant zone, we may describe for the steam mass flow rate (with air trapped in the condenser), $\dot{m}_{r,a}$, and steam velocity, $v_{r,a}$, with a stagnant zone of air, as:

$$\dot{m}_{r,a}=\dot{m}_s\left[\frac{\left(\frac{r}{r_s}\right)^2-1}{\left(\frac{R}{r_s}\right)^2-1}\right] \quad \text{Eq. 20}$$

$$v_{r,a}=\frac{\dot{m}_{r,a}}{2\pi\rho rL} \quad \text{Eq. 21}$$

Table 1 shows not only the above data as case 4, but also the effects of other reductions in the number of tubes available for condensation. It shows how excess backpressure increases with the number of tubes removed from the condensation process within the stagnant zone. As air blocks the number of tubes, principally in the center of the condenser driven by Steam Wind region 28, condenser backpressure and temperature will rise, increasing the condensation load per active tube.

It should be noted that the heat transfer coefficient, U, per tube does not change for active tubes, as can be observed from the use of Equation 6. It may be expected, as the load on a condenser increases, the value of $\Delta T_{lm}$ (as well as TTD) increases, with no change in U or A, as long as the tubes in A are active tubes.

This could explain most of the non-conformance with theory as presented by Gray, supra, for the large number of condensers he evaluated. Although he made these measurements following cleaning of the tubes, he showed no clear evidence that the exhausters were capable of removing air in-leakage sufficiently to prevent air caused excess backpressure in his study. It should become obvious that a coefficient, η (Table 1), should be used in Equation 6 to modify A, when air is present, in attempting to compute fouling contributions to changes in U.

Hotwell Temperature Behavior with Air In-Leakage

Common to condenser behavior with variable and known air in-leakage is that the hotwell temperature may or may not increase with the accompanying increases in condenser pressure and steam temperature. The model presented explains this variable behavior.

Referring to FIG. 8, the sixth case (33.3% case) shown in Table 1, the active tubes are those lying within the annular region, areas B and D, of the tube bundle. For condensate to reach hotwell, the condensate essentially drains downward in a vertical direction. Condensate produced in this region falls, reaching a surface vapor temperature of approximately 119° F. caused by impact of condensing steam. For the case indicated, the number of tubes in area D is 3,634 and these tubes produce a condensate mass flow rate $\dot{m}_{c,D}$ of 3,634×180.8 lbs/hr/tube=0.6570×10$^6$ lbs/hr. The other active tubes in annular region B, convert the remaining steam load to condensate at a rate of (2.4441−0.6570)×10$^6$=1.787×10$^6$ lbs/hr.

Let us now evaluate what happens to the temperature of condensate produced in area D as it falls through the stagnant area C having inlet circulating water temperature of 85° F. Using the heat transfer equation:

$$\dot{m}_{c,D}(T_{i,c}-T_{f,c})=\dot{m}_{cw}(T_{f,cw}-T_{i,cw}) \quad \text{Eq. 22}$$

assuming $c_{p,c}=c_{p,cw}$, and setting $T_{f,c}=T_{f,cw}=T_{f,cc}$ with c referring to condensate, cc to cold condensate, cw to circulating water, i is the initial temperature, and f is the final temperature, we can now solve for $T_{f,cc}$, after finding that $\dot{m}_{cw}/\dot{m}_{c,D}$=37.94 and knowing that, $T_{i,c}$=119.03° F. and $T_{i,cw}$=85° F. The result is that $T_{f,cc}$=85.87° F. A possible consequence of cooled condensate originating from area D reaching the bottom of area C having a mass flow rate of $\dot{m}_{cc}=\dot{m}_{c,D}$ at about $T_{f,cc}$=86° F. is that the cooled condensate can mix with condensate from all of area B, having a mass flow rate of $\dot{m}_c$ and a temperature of 119.0° F., resulting in a hotwell temperature, $T_{HW}$, given by:

$$T_{HW}=\frac{\left[\frac{\dot{m}_{cc}}{\dot{m}_c}\times T_{i,cc}+T_{i,c}\right]}{\left(\frac{\dot{m}_{cc}}{\dot{m}_c}+1\right)} \quad \text{Eq. 23}$$

This mixed condensate yields a hotwell temperature of 110.12° F., close to the initial no air hotwell temperature of 108° F. Whether this 2.12° F. difference is due to needed model refinements or energy mixing assumptions, the fact remains that it is far removed from what some observers may expect, 119.03° F.; and very close to some in-plant observations obtained when air induced backpressure increases are present. For this kind of mixing to occur, the cold condensate must reach the hotwell and mix with the hotter condensate, as stated, without being heated by the steam load passing downward between the condenser shell and tube nest crossing over to the central region and rising up through the falling cold condensate causing reheating. Since this can happen, depending upon condenser design, it is the reason that sometimes the hotwell temperature may rise with air in-leakage in some operating condensers.

This above described temperature difference between the hotwell temperature and vapor temperature is commonly recognized as "condensate subcooling." The noted excess backpressure is not caused by series thermal impedance, similar to what may be found from tube fouling, although this is the belief of many students of condenser engineering and science. It should be noted that condensate falling through area C indeed is subcooled, and finds itself, while in this region, in the presence of high concentrations of air. This condition becomes the major contributor to high dissolved oxygen (DO). Table 1 shows the results for other smaller stagnant regions of this condenser.

Conventional Condensers

The response shown here will be seen to have little difference in operating condensers. FIG. 9 shows a more practical condenser configuration for a condenser, 30, having a tube bundle, 32, a steam flow, 34, and containing an Air Removal Section (ARS), 36, with a shroud (baffle or roof), 37, a vent line, 38, and suction device or jet ejector (not shown), that exits the shell, 40, ending at an exhauster suction connection, 42. Let the steam load and number of tubes and all other conditions be the same as in the foregoing hypothetical condenser model and allow shrouded ARS 36 to occupy about 2 $ft^2$ of the tube sheet containing 84.3 tubes. For ease of description, let us further assume the exhauster to be of the piston type and that it has a displacement capacity, $\dot{V}$, in actual cubic feet per minute (ACFM) that is independent of suction pressure. Finally, let us assume that the exhauster capacity, $\dot{V}$, is nominally 2,000 ACFM.

If there is no air in-leakage, the system will operate essentially the same as before. All tubes will condense equal amounts of steam; and since there is no air in-leakage, the exhauster would not need to be operated and the load per tube would be 120.56 lb/hr. If, however, the exhauster were in service, it would remove an amount of water vapor (steam), $\dot{m}_s$, from the center of the condenser in the amount of:

$$\dot{m}_s=\rho_v\dot{V} \qquad \text{Eq. 24}$$

For a hotwell temperature of 108° F., $\rho_v$=0.003567 lb/$ft^3$, giving $\dot{m}_s$=7.135 lb/min or 428.1 lb/hr condensate loss rate from the condenser. Since this steam loss represents 0.017% of full load, it can, without apology, be ignored from energy balance consideration because its impact would be less than computational rounding error or measurement error contributions. It does, however, provide insight into the loss rate of condensate caused by an exhauster. As a result, however, there is no notable change in backpressure or the vapor and hotwell temperatures from that found for the hypothetical condenser with no air present.

If one now lets air flow, at a continuous rate, into the condenser sufficiently high in the condenser to have complete mixing with the steam, this air will be scavenged toward the center of the condenser where ARS 36 is located. The exhauster extracts this air at a rate equal to the input rate. As long as the gas mixture density times $\dot{V}$ is sufficient to extract though the vent line the water vapor and air mass flow rates following subcooling in ARS 36 at a water vapor to air mass ratio above about 3, the amount of air in-leakage will not contribute to the condenser's pressure. This value has been determined by the multi-sensor probe (MSP) measurements as an empirical parameter applicable to most condensers.

To understand the cause of condenser pressure saturation at low air in-leakage, one must first establish some boundaries. At low (to be defined below) air in-leakage and no air in-leakage, there is a range of in-leakage rates that will not affect condenser backpressure on the turbine. This is the region of zero excess backpressure. As mentioned above, MSP measurements have indisputably shown that all single pass and most dual pass condensers will have zero excess backpressure so long as the extracted water vapor to air mass ratio generally is above about 3. One, therefore, may analyze the case for $\dot{m}_v/\dot{m}_a$=3 to determine the threshold air in-leak value. This value also will be a measure of the exhauster's pumping capacity for air removal at the saturation suction pressure corresponding to the "no air in-leakage" hotwell temperature.

A value for the water vapor to air mixture mass ratio at the inlet of ARS 36 should be determined first such that the air content is not significantly reducing the heat transfer coefficient on the local tubes. This will allow the computation of individual gas components in vent line 38 at the exit of ARS 36 where $\dot{m}_v/\dot{m}_a$=3 is expected. If one assumes that the ARS 36 entrance mass ratio is 130, the amount of subcooling would be only 0.2° F. at that location, as may be determined from Eq. 18 and the steam tables. The resulting normalized heat transfer reduction would be only 20%, as can be seen from FIG. 7. Therefore, there would be no stagnant zone, 44, and the region of reduced heat transfer would not be significant or large.

Because of condensation in ARS 36 assisted by the velocity generated by the exhauster capacity, even with a presence of air, one can assume 6° F. subcooling. The water vapor density, therefore, is reduced from 0.003567 lb/$ft^3$ at 108° F. to 0.003020 lb/$ft^3$ at the exit of ARS 36. The amount of water vapor that passes to the entrance of vent line 38 is given by $\dot{m}_v=\rho_v$=2000=6.04 lb/min. This mass flow essentially passes on to the exhauster. Assuming $\rho_v/\rho_a$=3.2, then $\rho_a$=0.00094 lb/$ft^3$, so that $\dot{m}_a=\rho_a\times$2000=1.88 lb/min. This results in an air extraction value of 25.1 SCFM, which is consistent for exhausters encountered in the field having a 2,000 ACFM capacity. It should be noted that air in-leakage of greater than 25.1 SCFM will result in increasingly more subcooling of condenser tubes around the entrance to ARS 36. This leads to excessive subcooling of condensate in the presence of high oxygen concentrations, giving rise to high DO, as described above for the hypothetical condenser. This also explains why air in-leakage below 25.1 SCFM will not affect condenser backpressure.

Figure 10:
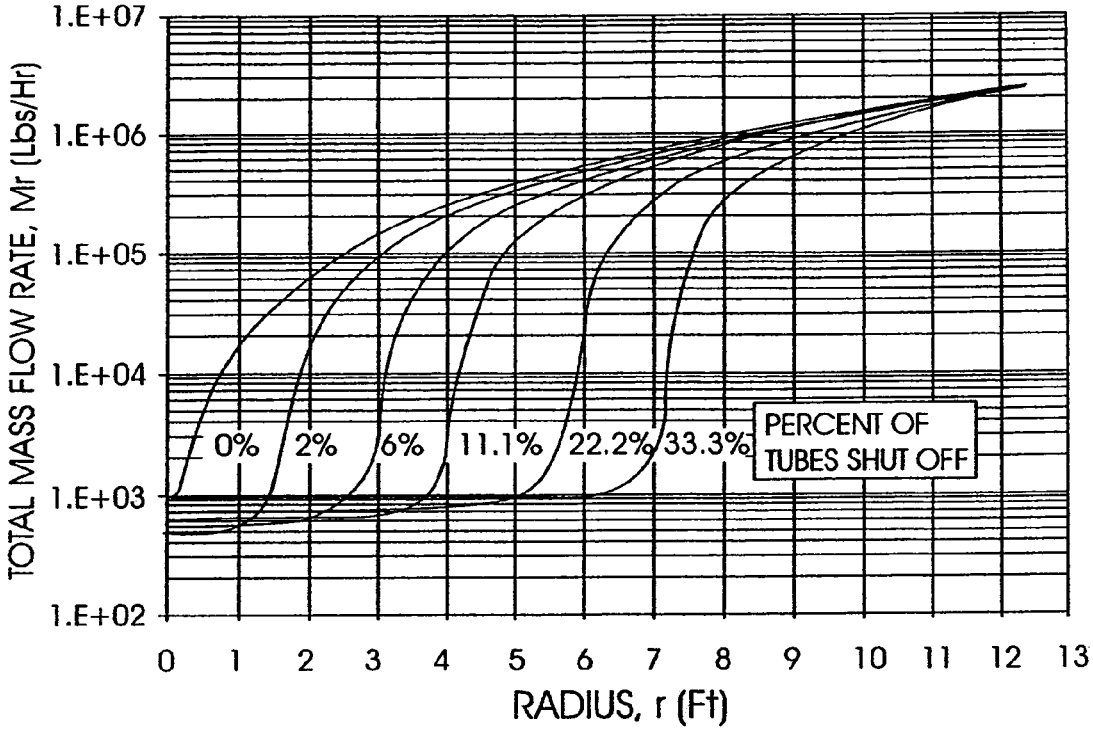
FIG. 10 graphically plots the total mass flow rate versus radius for an operating condenser with air in-leakage.

Table 3 represents the performance of a conventional condenser with various amounts of tubes removed from service resulting from excessive air in-leakage. The initial line is for zero tubes lost but for air in-leakage compatible with the capacity of the exhauster such that no excess backpressure is imposed on the turbine caused by the air in-leakage. As tubes are lost, the steam temperature, $T_s$, and total condenser pressure, $P_T$, will increase. The data for equilibrium in the stagnant zone was computed assuming linear subcooling between ARS 36 inlet temperature equal to the steam temperature when air in-leak causes no subcooling (no lost tubes), and an assumed maximum subcooling of 85° F. at an air in-leak resulting from 33.3% of tubes removed from the condensation process. From the subcooled region vapor temperature, $T_v$, the partial pressure of vapor, $p_a$, is obtained by subtracting the associated vapor partial pressure $p_v$ from $P_T$. Using Equation 18, $\rho_a$ is determined. Assuming a fixed 2,000 ACFM capacity exhauster, $\dot{m}_a$ and $\dot{m}_v$ are computed and their sum becomes the total mass flow rate, $\dot{m}_T$, being extracted from the condenser. From $\dot{m}_a$, the amount of air in-leakage responsible for the above parameter values is computed. Finally, the condenser backpressure is found by subtracting the no excess backpressure value of $P_T$ values found for each case of lost tubes. Using the following equation, $$\dot{m}_{r|r\geq r_s} = \dot{m}_s\left[\frac{\left(\frac{r}{r_s}\right)^2 - 1}{\left(\frac{R}{r_s}\right)^2 - 1}\right] + 0.0749\times 60\times SCFM \qquad \text{Eq. 25}$$

where the first term represents the steam mass flow rate and the second term represents the air mass flow rate, and $$\dot{m}_r|_{r=1} = (\rho_v + \rho_a)\times ACFM\times 60 \qquad \text{Eq. 26}$$

for the total mass flow rate exiting stagnant zone 44 at ARS 36, the total mass flow as a function of r is plotted as shown in FIG. 10. These curves are expected to be accurate down to where $\dot{m}_r$ is about 20,000 lb/hr and in the area of radius below one foot. To characterize the transition region where the steam wind and stagnant zones mix requires much more theoretical effort than is set forth herein. The dashed line is inserted more for its pictorial pleasantness than for accuracy. Although this region is not technically correctly represented, the displayed approximation does not detract from the overall model effectiveness in explaining condenser behavior. It should be noted that some liberty also was taken in writing Equations 25 and 26 to explain FIG. 10 mass flow rates, which, in reality, are more applicable to circular tube bundle geometry than to rectangular shape.

Figure 7:
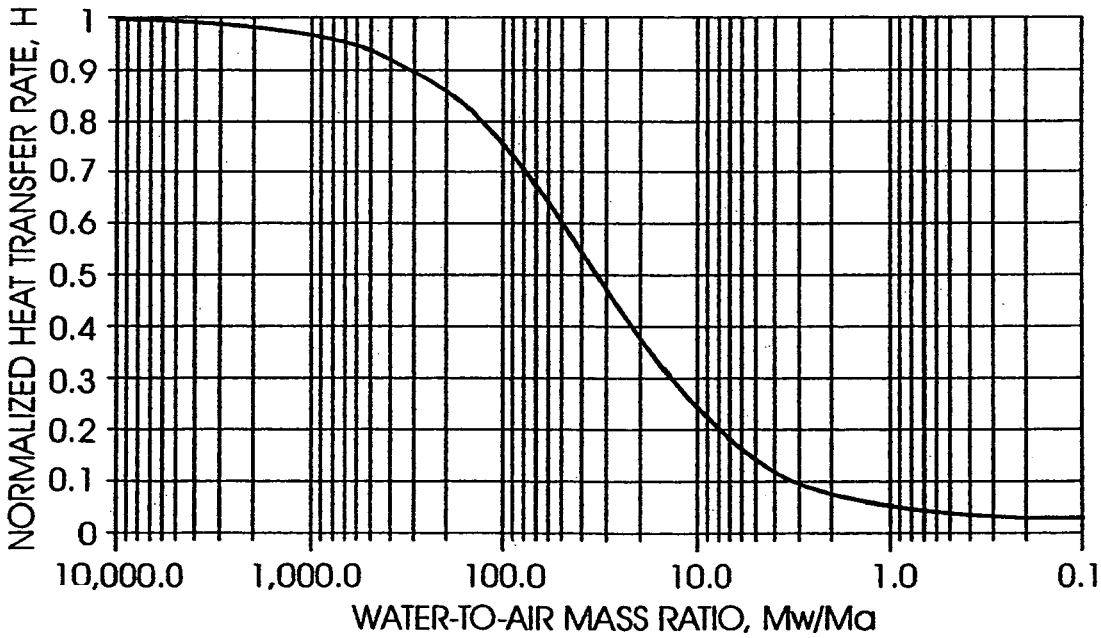
FIG. 7 graphically plots the ratio of measured heat transfer coefficient with air present, on a condensing tube, to the heat transfer coefficient with no air, plotted against water vapor to air mass ratio derived from data, as reported from single tube experiments by Henderson and Marchello, supra.
Figure 11:
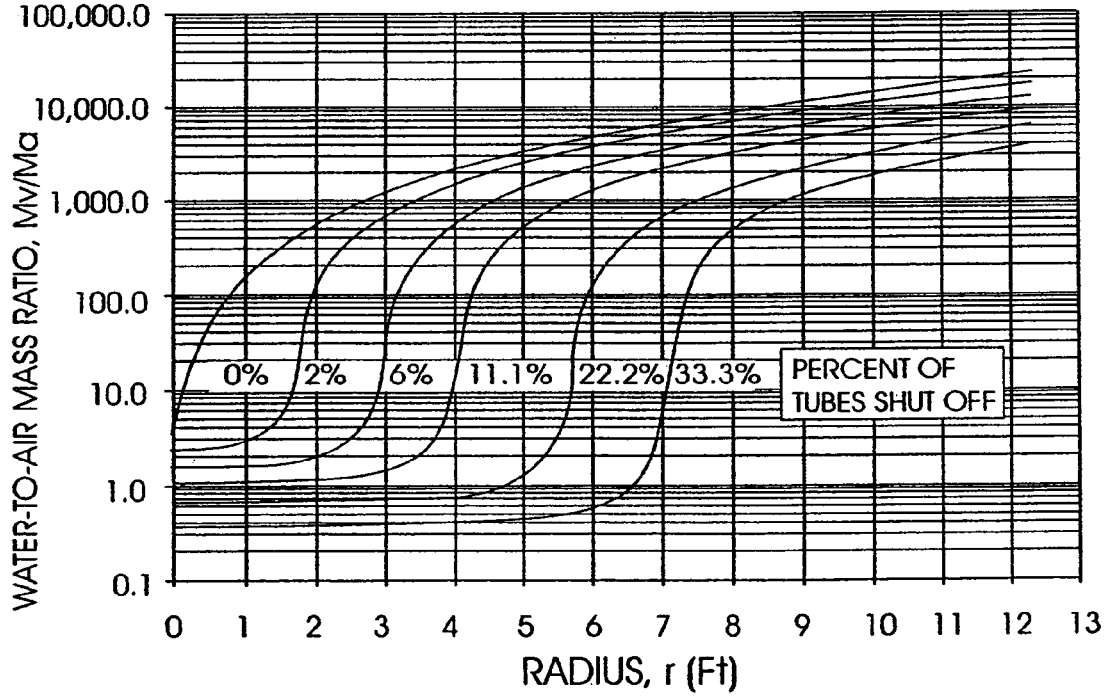
FIG. 11 graphically plots the water-to-air mass ratio versus radius for an operating condenser with air in-leakage.

For completeness and correlation of this model with work of Henderson and Marchello, supra, the water vapor (steam) to air mass ratio is shown as a function of radius in FIG. 11. Comparing these curves with their data represented in FIG. 7 provides a very good pictorial understanding of the role that air plays on heat exchange in a large operating condenser versus the detailed results of a well thought out experiment.

It should be mentioned that with a temperature sensor placed at the inlet of vent 38 at ARS 36, or a temperature sensor and relative saturation sensor placed in vent 38 outside of the condenser, some important data collected by the MSP can be determined. That is, the first temperature sensor alone will measure the saturation temperature of vapor leaving ARS 36, and the second temperature sensor and relative saturation sensor along with steam tables can be used to determine the same saturation temperature leaving ARS 36. Subtracting this saturation temperature from the steam vapor temperature is a measure of the subcooling, which, if below the approximately 6° F. value, is an indication of air build-up around condenser tubes causing their loss. Now, with tubes removed from condensation, the amount of air in-leak is determinable as shown in Table 2, below, for the size of air removal pump described. Little subcooling is expected at ARS 36 with sizing of the air removal pump (not shown) at suction connection 42. The foregoing discussion, of course, assumes that the operator knows the pump capacity and that the pump indeed is operable. Indeed, if air in-leakage is absent (or not significant), the temperature measurements also could be indicative that the ARS pump is not operating as designed or intended.

As an alternative to using a relative saturation sensor, an approximation of relative saturation can be calculated by measuring with temperature sensors the temperature in the vacuum line outlet and the temperature in the ARS vent line at its outlet. It should also be mentioned that by an indication of air in-leakage versus subcooling also can be determined by looking at the difference in temperatures of the incoming steam temperature and the temperature of in the ARS.

Returning to Table 1, where $\eta$ is determined from the initial hypothetical condenser, the effect of the stagnant zone is nearly identical in an operating condenser. Attention now may be diverted to show the significance of $\eta$. Examination of Eq. 9 shows that TTD is a function only of U, the heat transfer coefficient, on the basis that all other parameters in Eq. 8 are fixed or otherwise constant. This is no longer the case since from the new understanding discussed above, A should be replaced with $\eta A$, emphasizing that $\eta$ is a factor reducing the physical condensing surface area to an appropriate active condenser surface area, $\eta A$. Therefore, Eq. 9 must be modified as follows:

$$\text{TTD} = f(\eta U) \qquad \text{Eq. 9}$$

Before application of this formula, the meaning of TTD should first be understood. The easiest to measure in plant is the apparent TTD, which is the difference between the condenser backpressure saturation temperature, $T_v$, and the combined (mixed) circulating water temperature, $T_{cw2}$. The other is the difference between $T_v$ and the currently more difficult to measure temperature of the circulating water outlet temperature from the active zone tubes.

Figure 12:
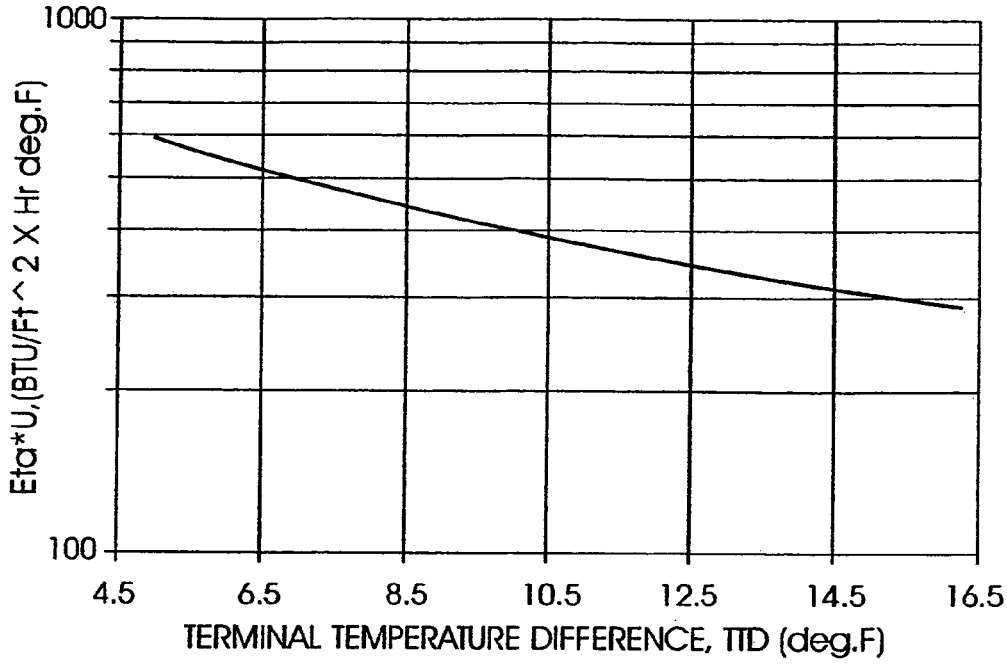
FIG. 12 graphically plots the eta coefficient, $\eta U$, as function of TTD for various air in-leakages.

FIG. 12 is a plot of $\ln(\eta U)$ versus the apparent TTD. The values of $\eta U$ are listed in Table 1 as the apparent heat transfer coefficient. If tubes are not fouled, the value of $\eta$ can be determined for a particular plant as a function of air in-leakage purposely introduced and measured by the MSP instrument to assure proper exhauster performance. This, then, becomes a calibration of $\eta$ as a function of air in-leakage and exhauster capacity. Subsequently, if the extent of tube fouling is to be determined, the MSP instrument would be used to determine the current value of $\eta$ from the above calibration. This would allow the measured (apparent) heat transfer coefficient $\eta U$, applicable to the total tube surface area to be corrected to a value applicable to the active tubes only. The corrected value of U then is compared to its design value (or known clean value) to reveal the amount of heat transfer coefficient change due to fouling.

TABLE 3

| % Main | | | Stagnant Zone | | | | | ARS Exit Flow Rate | | | | |
|---|---|---|---|---|---|---|---|---|---|---|---|---|
| Tubes Lost | $T_s$ (° F.) | $P_T$ ("HgA) | $T_v$ (° F.) | $p_v$ ("HgA) | $p_a$ ("HgA) | $\rho_v$ (lb/ft$^3$) | $\rho_a$ (lb/ft$^3$) | $\dot{m}_r$ (lb/hr) | $\dot{m}_v$ (lb/hr) | $\dot{m}_a$ (lb/hr) | AIL (SCFM) | $P_{EX}$ ("HgA) |
| 0 | 108 | 2.450 | 102 | 2.053 | .3970 | .00302 | .00094 | 475.2 | 362.4 | 112.8 | 25.1 | 0 |
| 2 | 108.46 | 2.483 | 101 | 7.992 | .491 | .00294 | .00116 | 491.5 | 352.3 | 139.2 | 30.97 | .033 |
| 6 | 109.45 | 2.556 | 98.9 | 1.870 | .686 | .00277 | .00163 | 527.5 | 331.9 | 195.6 | 43.52 | .106 |
| 11.1 | 110.83 | 2.650 | 96.3 | 1.728 | .932 | .00258 | .00223 | 575.6 | 308.0 | 267.6 | 59.5 | .210 |
| 22.2 | 114.45 | 2.950 | 90.7 | 1.453 | 1.497 | .00218 | .00361 | 694.6 | 261.7 | 433.2 | 96.40 | .500 |
| 33.3 | 119.25 | 3.276 | 85 | 1.213 | 2.163 | .00184 | .00528 | 854.4 | 220.80 | 633.6 | 141.0 | .926 |

Figure 13:
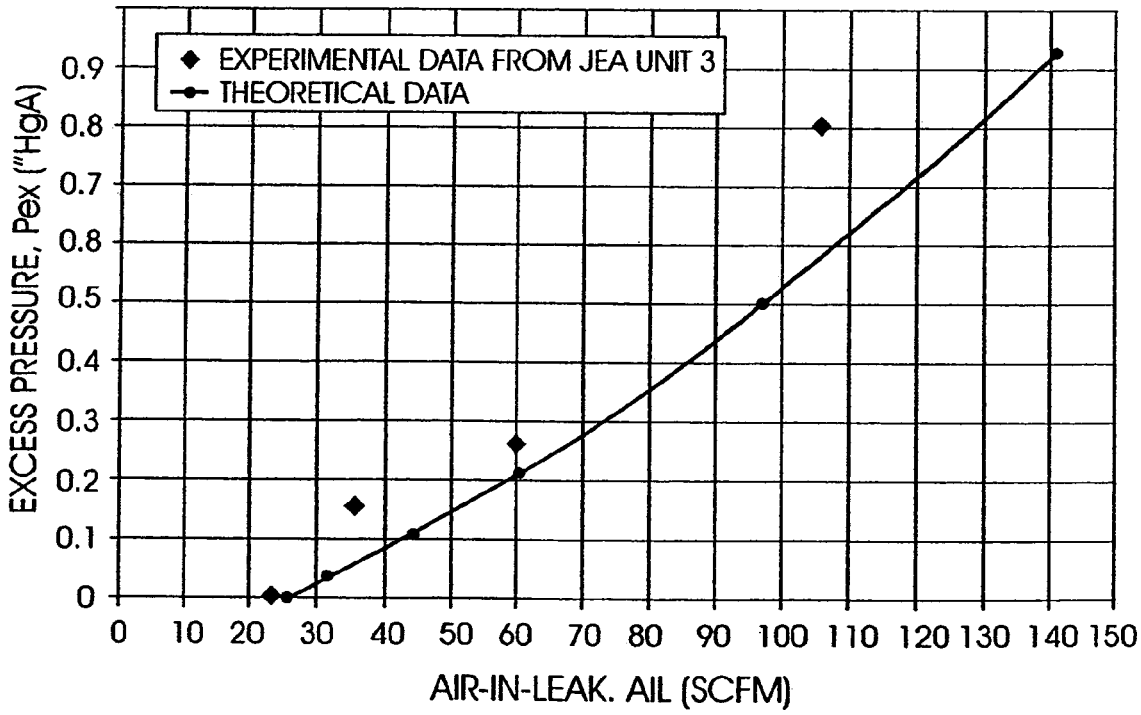
FIG. 13 graphically plots a comparison of excess backpressure versus air in-leakage for the theoretical model and for actual plant data.

Now returning to Table 2, these data are plotted in FIG. 13 showing the relationship between excess backpressure and air in-leakage. The theoretical curve represents data derived from the model. The rotated squares are from an operating plant, JEA Unit 3. The condenser for this plant unit is a single pressure, two compartment, divided water box, two-pass system. The hypothetical condenser used in this study was patterned after this condenser, to have a basis for the model, resulting in the large radius and length having a single compartment, single water box, and single pass configuration. The result was that these two condensers had the same condensing surface area.

The agreement between the plant data and model's theoretical response is considered excellent. This is as it should be since the model was developed as result of MSP measurement commonality from many plants across the country. Knowing exhauster capacity and the significance of $\dot{m}_v/\dot{m}_a=3$ (approximation) was paramount to formulating the model.

It should be noted that as air in-leakage becomes sufficient to allow stagnant zone 44 to develop around the ARS, tubes will become insulated, reducing the ability to condense steam, and the backpressure will rise in the condenser in the manner described for the hypothetical condenser. This along with stagnant zone subcooling and high DO can be a major cause for shell side tube corrosion on those tubes located near the central ARS section of condensers. In order to determine the presence and/or size of a stagnant zone, viz., stagnant zone 25 (FIG. 6), a series of thermocouples may be placed across the region expected to house stagnant zone 25. Such thermocouples can be carried by members disposed in a variety of geometries, such as, for example, along an "X" shaped member construction, 27. The temperature sensors or thermocouples will inform the condenser operator of a subcooling in zone 25, indicative of formation of a controllable stagnant air pocket. Adding more exhausters or searching for and fixing air leaks can control its size. By monitoring the temperature sensors along X-member 27, the efficacy of the exhausters can be determined by the condenser operator.

In order to overcome high DO caused by such subcooling, from entering the hotwell, a trough or drain, 46 (FIG. 9), is disposed beneath stagnant zone 44. Trough 46 collects the subcooled condensate falling from/through stagnant zone 44. Such collected subcooled condensate, then, is pumped via a pipe, 48, by a pump, 49, to a spray nozzle distribution system, 50, for injecting subcooled condensate into the incoming steam flow 34 for its re-heating by incoming steam flow 34. By reheating the subcooled condensate, the DO (and any other gas dissolved in the subcooled condensate) is relieved therefrom. The collection system can be operated automatically based on water sensors or liquid level sensors (not shown) that detect the amount of collected subcooled water in trough or drain 46 and/or may be activated based on temperature measurements as can be taken along "X" member indicated above. Trough 46 probably should be positioned under about one-third of the tubes in bundle 32 or other number of tubes based on experience for air in-leakage or exhauster reliability. A perforated or louvered roof (e.g., shroud or roof 51 of FIG. 9) in the vicinity of trough 46 in the vicinity of ARS shroud 37 may be installed to divert falling condensate from active tubes above the stagnant zone, reducing the amount of DO contaminated condensate for recirculation. The perforations should have a raised upper lip with an overhang to allow steam penetration under normal operation and prevent falling water fall-through. Regardless of the technique used for controlling the flow and the re-heating the subcooled condensate, DO can be driven from the water to aid in suppressing corrosion occasioned by the presence of DO in the condensate. In this regard, it will be appreciated that the size of trough 46 will vary depending upon the size of stagnant zone 44, which is a function of the amount of air in-leakage. At low air in-leakage, trough 46 may only need to be disposed under ARS 36. At higher air in-leakage, trough 46 may extend to substantially under all (or slightly more) of stagnant zone 44.

Alternatively, the bundle of tubes in stagnant zone 27 (FIG. 6) or 44 (FIG. 9) can be removed from their respective condensers and placed in a second or subsequent condenser or condenser zone under normal conditions of low air in-leakage becoming an extension of the first, but prevents the buildup of a stagnant zone therein under conditions of a large air leakage. Condensate from this second condenser function, then, maybe collected and sprayed into the first condenser for its re-heating and DO lowering.

In regard to condenser design, those condensers that utilize baffles to collect condensate for diversion to a hotwell probably should have such baffles perforated backpressure. This excess backpressure range can extend up to 1" HgA without being noticed. In addition to air in-leakage levels causing air binding and stagnant zones, similar effects are caused by degraded exhausters, which will yield high DO at low air in-leakages.

Table 2 (above) shows condenser ARS and stagnant zone parameters previously derived from the model for various stagnant zone size (% tubes lost) and assumed subcooling (beyond 6° F.), resulting in derived air in-leakage as found in an operating condenser. It should be noted that subcooling, which is $T_s$-$T_v$, covers the range 6° F. to 34° F. The total noncondensable gases partial pressure is shown as air partial pressure, given as $P_a$. Using Equation 27 and the relationship $$p_o=0.2p_a \qquad \text{Eq. 27}$$

for the oxygen partial pressure, the solubility of oxygen was computed. The constant of 0.2 is used instead of 0.21 for the oxygen content in air to arbitrarily account for 1% of the non-condensable gases being other types of gases ($CO_2$, $NH_3$, etc.). Values of the Henry constant shown here as the solubility in mole ratio at one atmosphere partial pressure, for $O_2$ (line 60) and $CO_2$ (line 62) are given in FIG. 14. The solubility (line 64) for oxygen (DO) is given in FIG. 15 as a function of subcooling shown in Table 2 at the temperature of $T_v$. The partial pressure of oxygen at atmospheres is derived from subcooling.

Figure 14:
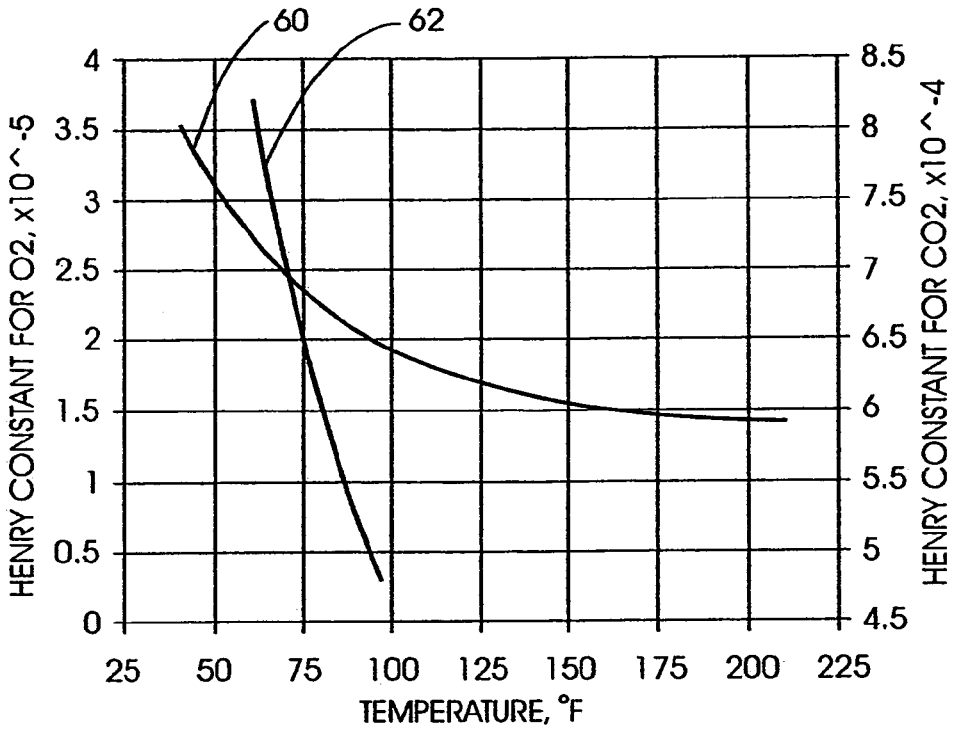
FIG. 14 graphically plots the Henry constant of gas in water at one atmosphere gas partial pressure versus temperature for carbon dioxide and oxygen.

To be noted is the DO value of 90 PPB at 6° F. subcooling, which occurs at the vent line entrance of the ARS section in the condenser. This occurs at a threshold air in-leakage value of 25 SCFM, above, at which point excess backpressure begins. Since the ARS represents about 0.5% of all tubes in the bundle, if we assume all of them are subcooled 6° F. and they produce the same amount of condensate as all other tubes, which they do not, then this source of DO would contribute 0.4 PPB to the total hotwell condensate. This assumes that the ARS condensate falling to the hotwelll is not regenerated by the condensing steam. The data for $CO_2$ in FIG. 14 is provided for information only.

Figure 15:
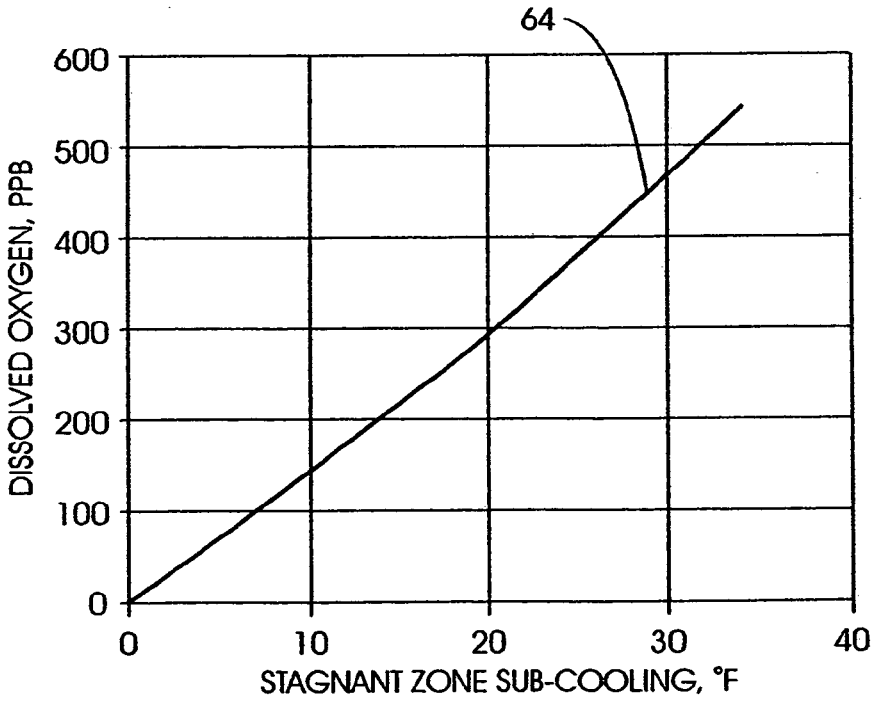
FIG. 15 graphically plots the upper limit of DO versus subcooling in condenser stagnation zones at 85° F. inlet cooling water temperature.

The remainder of the curve in FIG. 15 at larger subcooling is for air in-leakage, which contributes increasingly to excess backpressure as the stagnant zone grows to encompass 33% of the tube bundle. As the data of Table 2 show, excess backpressure then reaches 0.926" HgA. This condition is well within the range where plants could, out of necessity, stay at load, planning repairs at a future outage. The decision may only be made however, if the risk of corrosion could be substantially reduced.

Off-Line Operation

Figure 16:
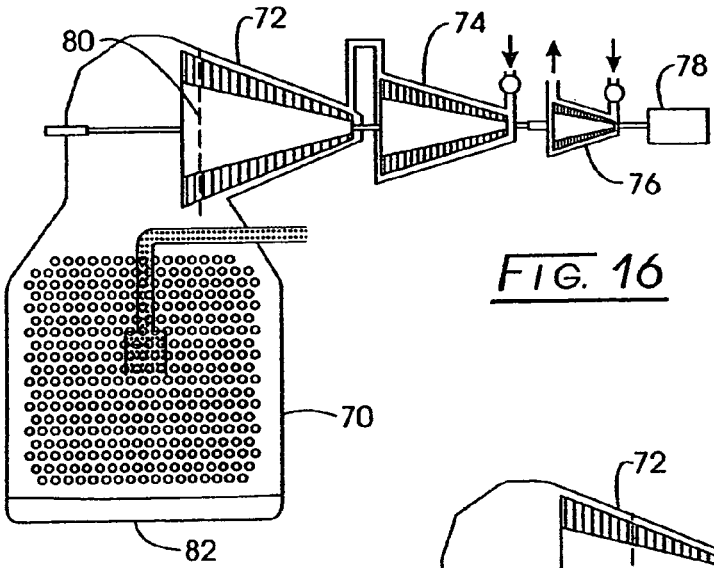
FIG. 16 is a simplified cut-away elevational view of a combined cycle plant (HRSG) showing the generator, high-pressure turbine, intermediate pressure turbine, low-pressure turbine, and condenser, operating under full load.
Figure 17:
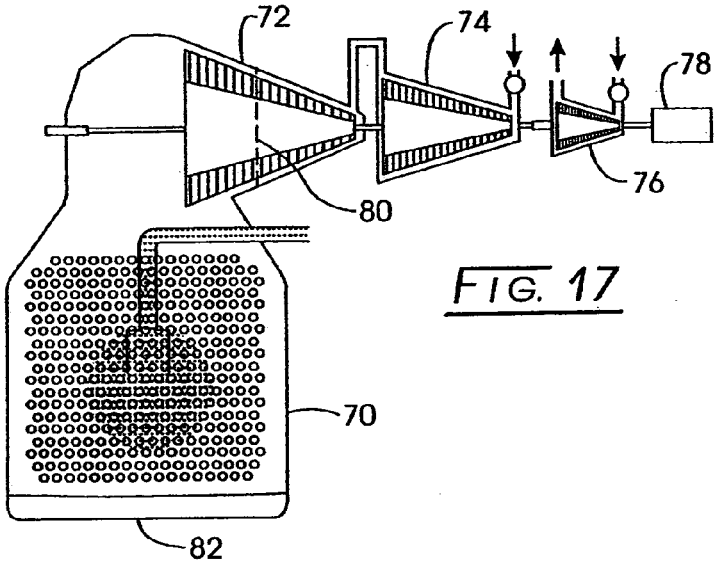
FIG. 17 is the combined cycle plant of FIG. 16 operating under reduced load.
Figure 18:
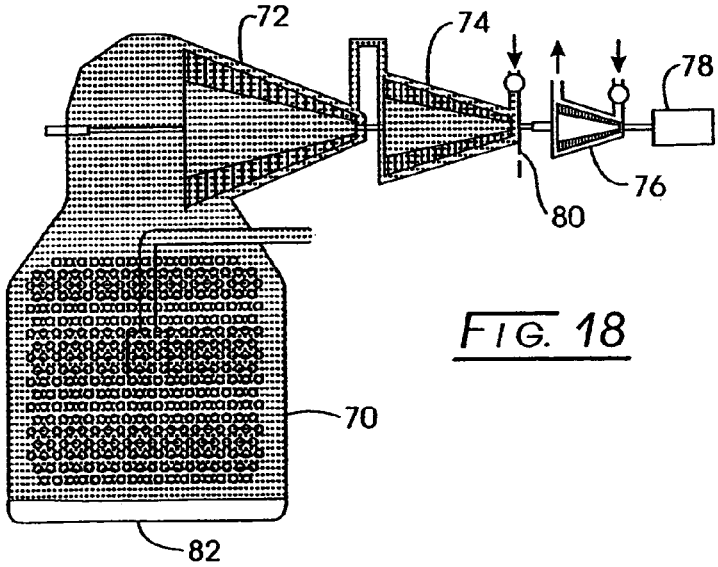
FIG. 18 is the combined cycle plant of FIG. 16 in an off-line or standby mode.

Off-line condensers for combined cycle plants, where it is sometimes recommended that vacuum be maintained on the condenser operations, are much different from the above online operation. FIGS. 16-18 depict a combined cycle plant that includes a condenser, 70, a low pressure (LP) turbine, 72, an intermediate pressure (IP) turbine, 74, a high pressure (HP) turbine, 76, and a generator, 78. Lacking the steam load, there is no scavenging process causing noncondensable gases to be dragged to the air removal section for removal. Noncondensable gases, therefore, are free to occupy the total vacuum space. This includes condenser 70, LP turbine 72, and IP turbine 74, feedwater heaters, instrumentation sensors, and all open drain/return lines, including ancillary equipment up to the isolation device (not labelled) separating this vacuum space from the outside atmosphere or other components. Dashed line 80 shows the approximate extent of the condenser vacuum location for the combined cycle plant operating under full load, FIG. 16; under reduced load, FIG. 17; and under off-line or standby mode, FIG. 18. It will be observed that the vacuum is confined mostly to condenser 70 under full load operating conditions, but moves well into LP turbine 72 under reduced load. In off-line mode, the vacuum includes both LP turbine 72 and IP turbine 74 (FIG. 18). The amount of gases being removed by the exhauster depends on condenser pressure, which would be the sum of the noncondensable gases' partial pressure and the partial pressure of liquid condensate. The latter component would quickly become, after going off-line, the saturation pressure at the temperature of the stored hotwell condensate in hotwell 82 in condenser 70.

For most of the offline period the hotwell condensate temperature would dictate the water vapor pressure $p_{wv}$. This in turn determines the water vapor density, $\rho_{wv}$, as may be found from the inverse of the specific volume listed, generally, in steam tables. One may examine the effects of air in-leakage on hotwell condensate dissolved oxygen (DO) using data and methods discussed elsewhere.

Assuming a hotwell temperature of 80° F., gives, $p_{wv}$=1.03" HgA and $\rho_{wv}$=0.00162 lb/ft$^3$. Further, assume an exhauster having a fixed capacity ($C_p$) of 2000 ACFM. The air density, $\rho_a$, in the condenser shell space will be a function of the air in-leakage rate, $F_a$ (SCFM), and air density at standard conditions, $\rho_o$=0.0749 lb/ft$^3$, given by:

$$\rho_a=\rho_o F_a/C_p=37.5\times10^{-6}F_a \quad \text{Eq. 28}$$

The partial pressure of air in the condenser is obtained using a well-known relationship derived from the ideal gas law given by:

$$p_a=0.622p_{wv}(\rho_a/\rho_{wv}) \quad \text{Eq. 29}$$

From Equation 29 we can determine the partial pressure of oxygen in the condenser from the percentage of oxygen in air or:

$$p_o=0.21p_a \quad \text{Eq. 30}$$

Knowing the partial pressure of oxygen in the condenser, one can determine the level of DO using Henry's Law and knowledge of the solubility of oxygen at some other temperature and pressure. FIG. 14 provides the relationship for oxygen (and carbon dioxide) solubility at a partial pressure of one atmosphere having the units of [moles gas/(moles water H $p_o$ (atmosphere))], sometimes referred to as the Henry constant, $H_o$. The relationship determining the DO equilibrium concentration in PPB becomes, $X_o=H_o p_o$, where $p_o$ is the partial pressure of oxygen in atmospheres.

Table 4 shows the results for air in-leakage from 5 to 50 SCFM, if the hotwell is allowed to reach equilibrium with the air partial pressure. These values are much higher than what may be expected for online condensers where scavenging prevents having an air partial pressure throughout the condenser. The results point to the importance for operating a tight condenser.

It should be recognized that the concentration in the final column of Table 4 can be halved if two exhausters were placed in service increasing the pumping capacity to 4000 ACFM. Additional pumping capacity would have a proportional affect. Other dissolved gases, like carbon dioxide, in FIG. 14 can be similarly determined.

TABLE 4

Hotwell Condensate DO in Offline Condenser*

| Air In-leak ($F_a$) SCFM | Air Density ($\rho_a$) $10^{G3}$ lb/ft$^3$ | Ratio $\rho_{wv}/\rho_a$ | Air Partial Pressure ($\rho_a$) "HgA | Condenser Pressure ($P_T$) "HgA | Oxygen Partial Pressure ($\rho_o$) Atmospheres | DO PPB |
|---|---|---|---|---|---|---|
| 5 | 0.187 | 8.66 | .0745 | 1.104 | .00052 | 12 |
| 10 | 0.375 | 4.32 | .1480 | 1.178 | .00104 | 23 |
| 25 | 0.936 | 1.73 | .3700 | 1.400 | .00261 | 58 |
| 50 | 1.873 | 0.86 | .7450 | 1.772 | .00523 | 117 |

Figure 19:
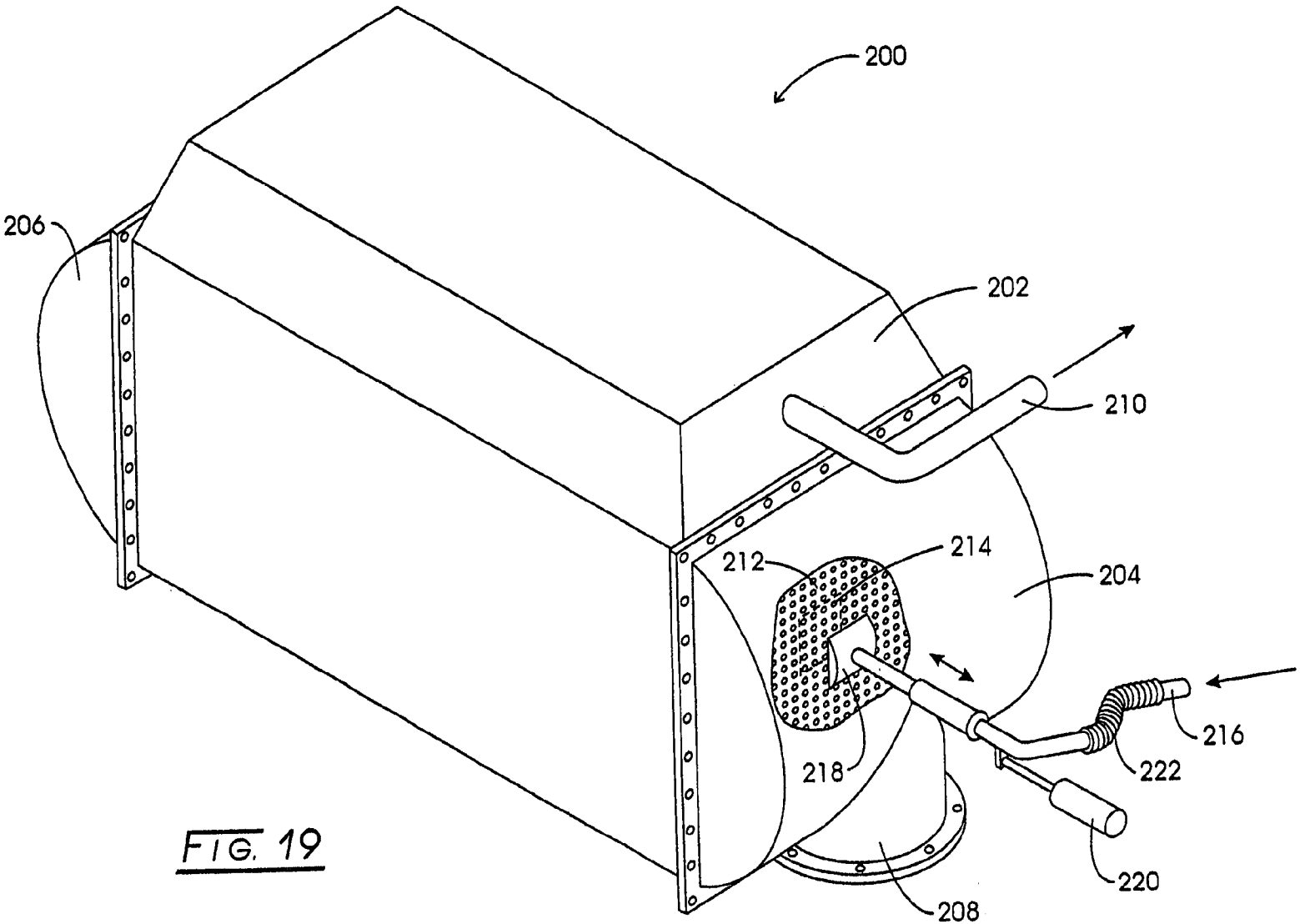
FIG. 19 a perspective view of a condenser used in a combined cycle plant, which condenser is fitted with cold water flow that can be actuated to selectively flow in the ARS section only.

*Conditions: 80° F; $\rho_{wv}$ = .00162 lb/ft$^3$; pwv = 1.03" HgA; Exhauster Capacity Cp = 2000 ACFM A proposed solution to this off-line vacuum problem is shown in FIG. 19 in which a condenser, 200, of a combined cycle plant is seen to consist generally of a hood, 202, water boxes, 204 and 206, at either end of condenser 200, a cold water inlet, 208, and a vent line, 210. Water box 204 is seen to be partially cut-away to review a tube sheet, 212, which retains the water tubes. The air removal section (ARS) tubes, 214, are labeled for convenience. It is about tubes 214 that the air will preferentially concentrate, provided that some flow is maintained in condenser 200. The damage of any air in-leaking into condenser 200 can be minimized, if not obviated, by selectively cooling on ARS tubes 214. This can be accomplished using a cold water inlet pipe, 216, that terminates inside water box 204 with a shroud, 218, that is retractable away from and into contact with tube sheet 212 using a hydraulic motor, 220, connected to inlet pipe 216, which can be fitted with a flexible section, 222, as shown in FIG. 19. When shroud 218 is extended into contact with tube sheet 212, cold water can be admitted into condenser 200 only through ARS tubes 214 and, thus, account for any air that has leaked into condenser 200 while it is off-line. This is true because a low flow of steam is admitted into IP turbine 74 (FIG. 18) to scavenge any in-leaked air in IP turbine 74, LP turbine 80, and condenser 70 (or condenser 200 in FIG. 19). Collection of the contaminated condensate from tubes 214 (FIG. 19), then removes DO.

Alternative to the condenser design in FIG. 19, the operator could dispose a separate water box and tube bundle (as describe in connection with FIG. 19) above condensate collection chamber 142 (FIG. 21) and pass cooling water only through this tube bundle during off-line operation of the combined cycle plant. Condensate could be collected in condensate collection chamber 142 and sent to storage or to an on-line condenser for spraying with inlet steam to re-vaporize condensed gases. Again, a low flow of steam introduced into IP turbine 74 (or at another convenient location) provides the driving force for any in-leaked air to be scavenged to the tube bundle with water flowing therethrough.

Practical Condenser Design

A more typical tube bundle configuration than shown earlier is presented in FIG. 20. A condenser, 90, contains six separate subsections, 92-100, one of which, section 100, is within the ARS shroud, 102, which is connected by an air removal line, 104, to a pump or other source of suction. Four horizontal trays, 106-112, having a high lip along the internal edge are used to catch condensate from tube bundles above, diverting the flow to the outer edge of the bundle where it is allowed to fall to the hotwell, 114, for collection, storage, and reuse. The purpose of trays 106-112 is to prevent the tubes below from being inundated with excess condensate, which would inhibit steam flow to these tubes leading to hotwell subcooling. The purpose of the central cavity, 116 and opening along the middle of the trays is to provide a path for air to reach the bottom of ARS shroud 102 for removal. The internal raised lip prevents flow of condensate from the tray entering the airflow path in the central cavity. Turbine exhaust steam enters from above surrounding the tube bundle entering from all sides including up from the bottom, as indicated by the series of arrows.

Figure 20:
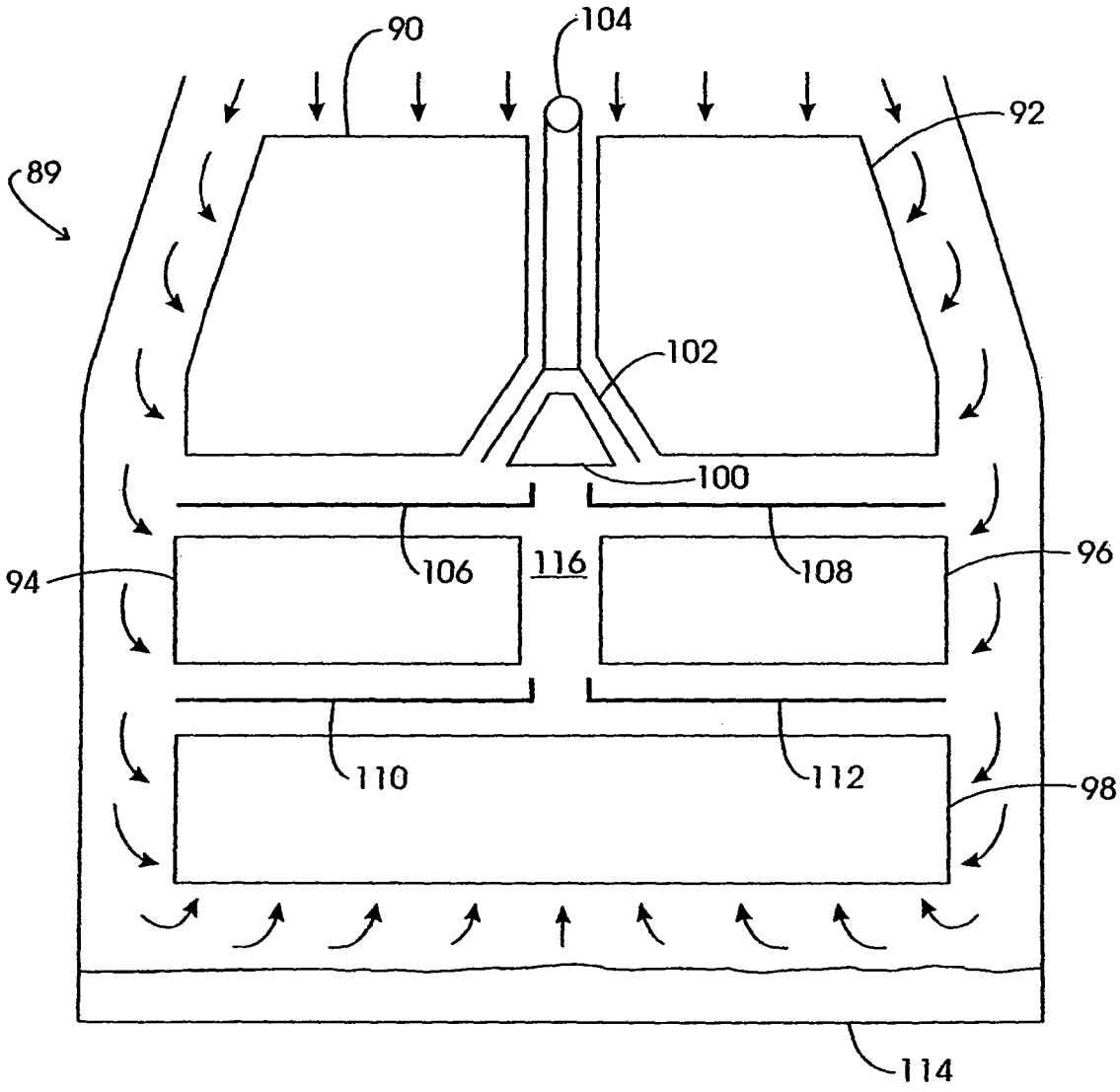
FIG. 20 is a simplified cut-away elevational view of a condenser with a common condenser tube bundle configuration.
Figure 21:
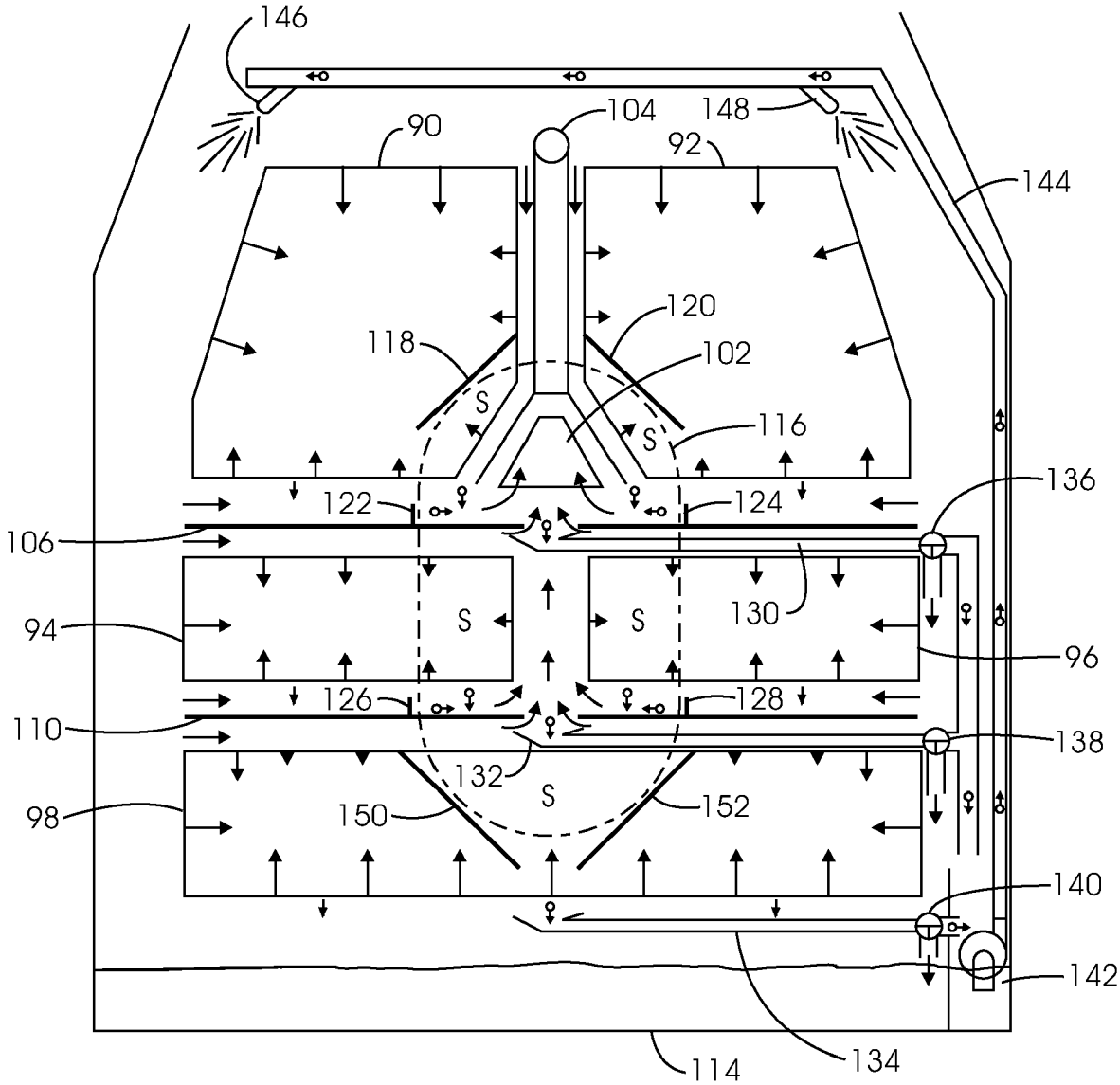
FIG. 21 depicts the condenser configuration of FIG. 16 fitted with high DO condensate separation and collection.

FIG. 21 (using the same tube bundle, hotwell, trays, and ARS numbering as in FIG. 20) depicts the steam flow within the tube bundle under conditions of high air in-leakage where there exists a large stagnant zone, 116. The affected area of each subsection is labeled with and "S." Since the percentage of tubes removed from the condenser is about 20%, the excess backpressure (EBP) would be about 0.5" HgA (see Table 2). In this condenser configuration, the contaminated condensate falling through the "S" zones would be oxygenated and with high DO fall onto trays and quickly enter hotwell 114 without regeneration. All trays would be contaminated and the large condensate flow from them would not completely reheat during its fall to hotwell 114.

Also, shown in FIG. 21 is a modification of the configuration of FIG. 20 to prevent significant amount of this contaminated condensate, from mixing with other condensate and finally entering hotwell 114. Baffles, 118 and 120, preferably perforated to allow for steam flow, are positioned between tubes above the "S" zones in sections 90 and 92 to divert condensate falling from tubes above the "S" zones from passing down through stagnant zone 116. Dams, 122-128, are placed in each tray, 106-112, respectively, parallel to the tubes, at the position of any anticipated stagnant zone 116 boundary to prevent condensate, produced in or passing through stagnant zone 116, from flowing to the outside portion of each tray. By removing the inner high lip on each tray and attaching shallow funnel troughs or drains, 130 and 132, below the tray openings, the contaminated subcooled condensate can be collected and diverted via valves, 136-140, either by pipe or a lower tray to outside the tube bundle on both sides (only one shown in FIG. 21) to collection chamber 142. Alternatively, this condensate, if not contaminated, can be diverted directly to hotwell 114. The purpose of chamber 142, located in the hotwell region, is for recycling contaminated condensate via a line, 144, to the top of the condenser where it is sprayed using pump 143 via spray heads, 146 and 148, into the steam environment for the purpose of reheating and removal of dissolved gases.

Finally, baffles, 150 and 152, preferably perforated, like those installed in the top two sections, are installed in the upper mid position of section 98 such that any contaminated condensate from its "S" zone can be concentrated and collected by a trough and pipe arrangement, 134, below tube bundle 98 for diversion of contaminated condensate to chamber 142, or directly to the hotwell, if not contaminated.

Measurements of DO in each of the contaminated condensate paths could be made to activate or deactivate the deaeration cycle as needed. If air in-leakage is sufficiently low and the tube bundle "S" regions are not present the condensate stream can be connected directly to the hotwell using automatic or manual control. The upper collection circuit directly under the ARS would normally have some DO since even small air in-leakage is concentrated at this location resulting in some amount of subcooling and a non-condensable gas partial pressure.

Where plants have a history of low air in-leakage a simpler collection strategy could be designed. Subcooling could be limited to only tubes within the ARS. Since the ARS is blocked with a shroud there is no contamination of falling condensate from regions above and only a collection trough or drain would be required. A smaller pump to deliver the contaminated condensate to the spray heads would be sufficient.

Other sources of DO (Air Binding)

Figure 22:
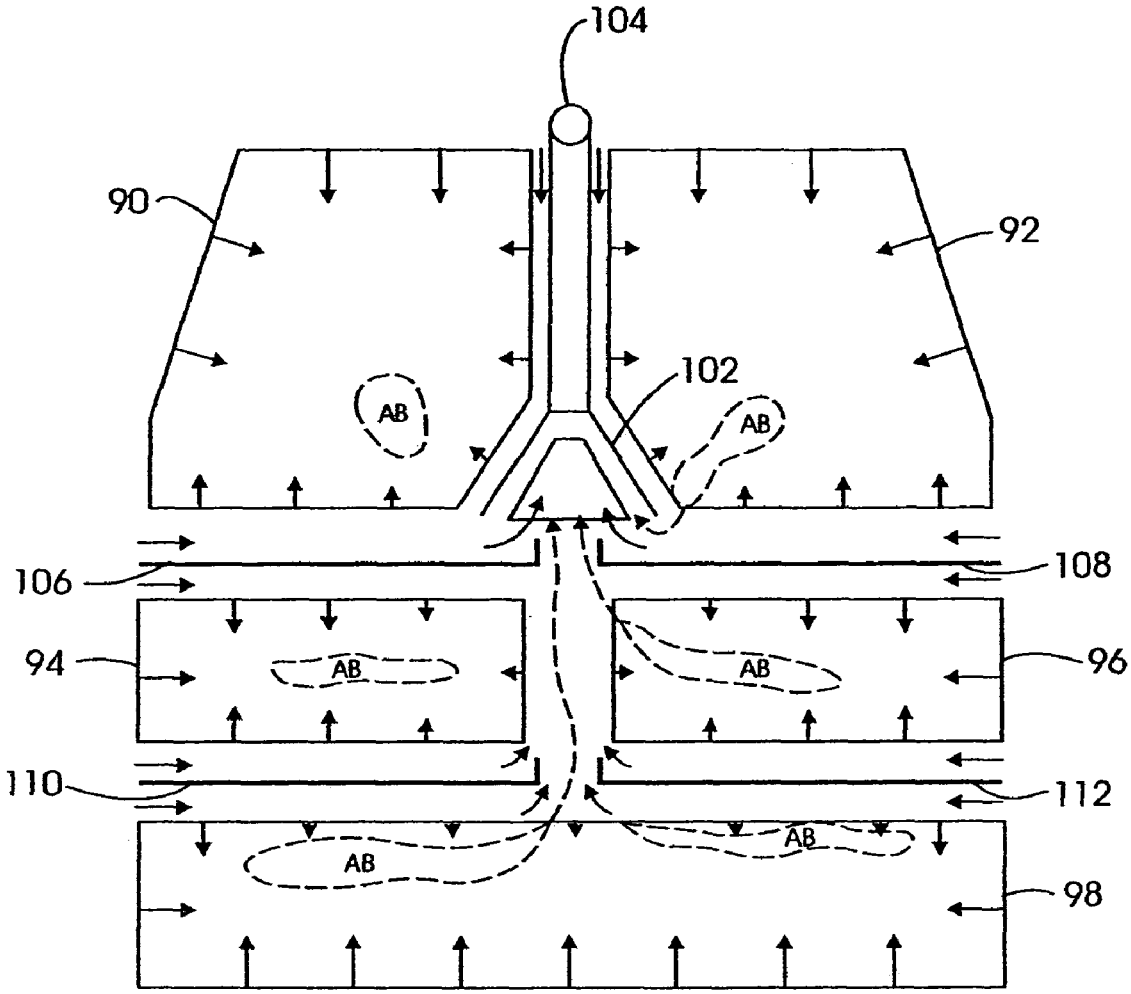
FIG. 22 depicts the condenser configuration of FIG. 16 showing possible air bound regions at low air in-leakage.

Another major source of DO is present in many condensers and is present even at very low air in-leakage values. FIG. 22 shows the same tube bundle arrangement as is depicted in FIG. 20, but from a different perspective for clarity. Here steam enters the tube bundle sections 90-98 from all sides including those along condensate trays 106-112 and open spaces between the sections. The entering steam is turbine exhaust steam having a water vapor to air mass ratio of generally greater than 5,000/1 and, therefore, highly "condensable." As this steam passes along a tray, e.g., tray 106, it is condensed on nearby tubes decreasing in velocity, but not changing in its mass ratio. As it enters the tube bundle section, along these internal section "boundaries" steam is removed at each layer of tubes that it passes and the mass ratio decreases. This is the same scavenging process described for the basic model. As such, entrapped air is concentrated deep within the bundle section where there is no ARS. This results in the development of Air Bound (AB) regions, labeled as AB in FIG. 22 and applies to all tube bundle sections, except for those in the ARS.

Air bound regions AB are not much different from the stagnant zone described earlier, except that trapped air is not being removed by an exhauster. The consequences of these air bound regions include: these regions grow in size over time, are subcooled by the entrapped air, the air and water vapor pressure add up to equal the pressure of the surrounding steam, and condensate falling through the AB regions become aerated. If the AB regions are close to a tray or liquid condensate path to the hotwell, contaminated condensate enters this stream, contaminating the hotwell.

Another feature of AB regions is they, like stagnant zones, decrease the condensing surface area with a consequential loss in active condenser surface area and in condenser performance. The net heat transfer coefficient of the condenser is decreased.

The AB regions grow in size to where they reach a "weak" inner edge of the bundle section and most probably collapse, or nearly so, where air is released to the ARS flow path giving rise to pulsations in flow of air being removed from the condenser via ARS shroud 102, as has been measured by the RheoVac® multi-sensor probe RVMSP instrument.

Figure 23:
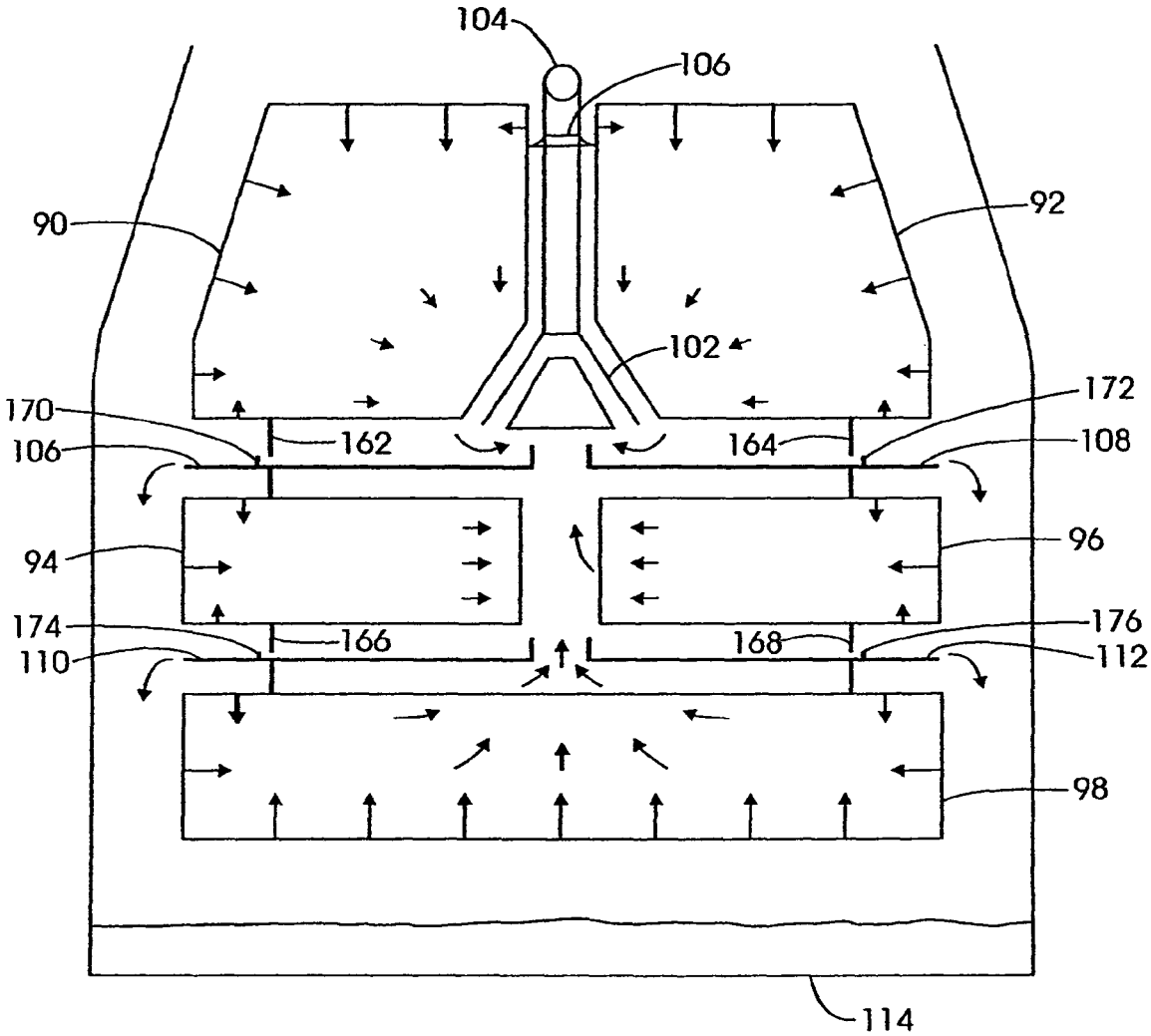
FIG. 23 depicts the condenser configuration of FIG. 18 fitted anti-air binding capacity.

To eliminate or minimize AB regions, steam flow between the tube bundle sections must be sufficiently interrupted. FIG. 23 shows how this can be accomplished. Steam entering the large opening in the top of tube bundles required for vent line 104 to be connected to ARS shroud 102 needs to be restricted. A barrier, 160, is shown extending the length of the tube bundle for this purpose. The height position is variable, but sufficient to prevent air entrapment in tube bundle sections 92 and 93 from this exposed side adjacent to vent line 104. Steam flow barriers, 162-168, are installed along the length of the condenser near the outer edge tube bundle above and below condensate trays 106-112, respectively. Conveniently, liquid barriers or traps, 170-176, can be placed on the condensate side of trays 106-112, respectively, to seal off and trap the free flow of steam along the tray but allow tray condensate drainage. Other configurations may be employed taking advantage of steam flow from the hot end of the condenser to the circulating water inlet end because of mixing dynamics that may also aid in preventing AB regions. The distance from the outer lip of the trays to barrier location is a variable to be determined by analysis and tests.

Features to remove AB regions and to prevent DO from entering the hotwell at high air in-leakage, described in the previous section, may be totally different than described here for new condenser designs. It is anticipated that condensers can be designed where DO can be reduced to 3 PPB or better.

Effects of Purging

The model predictions and previous discussions permit the subject of purging with an inert gas to be addressed on a sound engineering basis. Condensers having high DO with little air in-leakage are very likely to have air bound zones in the tube bundle subsections. These sections are somewhat stable, but pulsating regions and exist at low air in-leakage below the condenser pressure saturation level. The introduction of $N_2$ gas at a most favorable position in the condenser would cause a dilution in the average amount of stored air, hence the oxygen concentration, lowering its vapor pressure and reducing the amount of DO. This would be done without increasing the condenser backpressure and plant heat rate. All condensers having high DO and low air in-leakage should be evaluated for air binding regions to reduce corrosion and chemical treatment. The RVMSP instrument is useful to identify this condition.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the U.S. system (i.e., pound, foot, ° F.) and all amounts and percentages are by weight, unless otherwise expressly indicated. Also, all citations referred herein are expressly incorporated herein by reference.

I claim:

1. In a condenser of the type having a housing inside in which is disposed a plurality of water tube bundle sections, spaced-apart condensate trays disposed beneath at least some of said water tube bundle sections, a steam inlet for steam to flow inside said housing for contacting said tube bundle sections for heat removal, and potentially having a stagnant zone of high air concentration during operation wherein any air inleakage and noncondensable gases preferentially collect and condensate in said air zone becomes subcooled, allowing said air to become partially absorbed by said subcooled condensate, and which is fitted with an air removal section (ARS) disposed in or near said stagnant air zone, the improvement which comprises:

(a) dams placed in each condensate tray at about the outer boundary of said potential stagnant air zone in an outward direction away from the stagnant air zone for preventing subcooled condensate in said condensate trays in said stagnant air zone from leaving said stagnant air zone; and (b) drains placed beneath each condensate tray disposed within said stagnant air zone for diverting subcooled condensate in said condensate trays in said stagnant air zone for collection;

(c) baffles placed through each tube bundle section above said stagnant air zone to prevent condensate from passing into said stagnant air zone; and (d) baffles placed through each tube bundle below said stagnant air zone for diverting condensate to a collection drain placed below said stagnant air zone for collection of said subcooled condensate.

2. The condenser of claim 1, wherein said diverted subcooled condensate is subject to deaeration.

3. The condenser of claim 2, wherein said diverted subcooled condensate in said drains is reheated to steam temperature for release of dissolved gases.

4. The condenser of claim 3, wherein said diverted subcooled condensate is sprayed into said inlet steam for revaporization of dissolved gases.

5. The condenser of claim 1, wherein said baffles are perforated.

6. In a condenser of the type having a housing inside of which is disposed a plurality of water tube bundle sections, spaced-apart condensate trays disposed beneath at least some of said water tube bundle sections, a steam inlet for steam to flow inside said housing for contacting said tube bundle for heat removal, and having a stagnant zone of high air concentration during operation wherein any air in-leakage preferentially collects and condensate in said air zone becomes subcooled, allowing said air to become partially absorbed by said subcooled condensate, and an air removal section (ARS) disposed in or near said stagnant air zone and having a vent line connected to an external air removal device, which vent line runs one or more of vertically or horizontally in a gap between water tube bundle sections, the improvement for retarding air binding caused by steam scavenging of air to locations in said water tube bundle sections not having an ARS, which comprises:

(a) a barrier placed at a depth around said ARS vent line and between tube bundles to prevent entering steam from flowing deeply into said gap between said water tube bundle sections; and (b) steam flow barriers placed at a depth between the outer and inner edges of said condensate trays and extending upwardly and downwardly from said condensate trays to said water tube bundle sections, the flow of condensate in said condensate trays not being impeded by said steam flow barriers.

7. The condenser of claim 6, which further comprises one or more of the stops of providing:

(c) low profile liquid barriers placed upwardly from said condensate trays and outwardly from said steam flow barriers to form a liquid trap to further restrict steam flow from outside said water tube bundle sections inwardly adjacent to said condensate trays, the flow of condensate outwardly on said condensate trays not being impeded by said liquid traps;

(d) dams placed in each condensate tray at about the outer boundary of said stagnant air zone for preventing subcooled condensate in said condensate trays in said stagnant air zone from leaving said stagnant air zone in an outwardly direction away from said stagnant zone;

(e) drains placed beneath each condensate tray disposed within said stagnant air zone for collecting subcooled condensate from said condensate trays in said stagnant air zone; or (f) baffles placed through each tube bundle above said stagnant air zone to prevent condensate from passing into said stagnant air zone.

8. The condenser of claim 6, wherein said collected subcooled condensate in said drains is subjected to deaeration.

9. The condenser of claim 8, wherein said collected subcooled condensate in said drains is subject to one or more of reheating to release dissolved gases, its pressure is lowered for release of dissolved gases, or is placed in contact with said inlet steam for reheating and release of dissolved gases.

10. The condenser of claim 7, wherein said baffles are perforated.

11. A method for operating a condenser of the type having a housing inside of which is disposed a plurality of water tube bundle sections, spaced-apart condensate trays disposed beneath at least some of said water tube bundle sections, a steam inlet for steam to flow inside said housing for contacting said tube bundle for heat removal, and potentially having a stagnant zone of high air concentration during operation wherein any air from high in-leakage or noncondensable gases preferentially collect and condensate in said stagnant zone become subcooled, allowing said air to become partially absorbed by said subcooled condensate, and having an air removal section (ARS) comprising a vent line connected to an air removal device, the improvement which comprises:

(a) placing dams in each condensate tray at about the outer boundary of said stagnant air zone for preventing subcooled condensate in said condensate trays in one or more of said stagnant air zone or said ARS from leaving respectively said stagnant air zone or said ARS in an outward direction away therefrom; and (b) placing drains beneath each condensate tray disposed within one or more of said stagnant air zone or said ARS for collecting subcooled condensate from said condensate trays respectively in said stagnant air zone and said ARS;

(c) placing baffles through each tube bundle section above said stagnant air zone to prevent condensate from passing downwardly through one or more of said stagnant air zone or said ARS; and (d) placing baffles through each tube bundle section below one or more of said stagnant zone or said ARS for diverting any subcooled condensate to a collection trough placed below respectively said stagnant zone or said ARS for collection and treatment of said subcooled condensate to release any dissolved gases.

12. The method of claim 11, wherein said collected subcooled condensate is deaerated for release of dissolved gases.

13. The method of claim 11, wherein said diverted subcooled condensate in said drains is placed in contact with said inlet steam for reheating and release of dissolved gases.

14. The method of claim 11, wherein said baffles are perforated.

15. A method for operating a condenser of the type having a housing inside of which is disposed a plurality of water tube bundle sections, spaced-apart condensate trays disposed beneath at least some of said water tube bundle sections, a steam inlet for steam to flow inside said housing for contacting said tube bundle for heat removal, and potentially having a stagnant zone of high air concentration during operation wherein at high air in-leakage, air or non-condensable gases preferentially collect and condensate in said air zone becomes subcooled, allowing said air to become partially absorbed by said subcooled condensate, an air removal section (ARS) disposed in or near said stagnant air zone also having subcooled condensate and having a vent line that runs one or more of vertically or horizontally within a gap between said water tube bundle sections, and a hotwell for collection of condensate, the improvement for retarding air binding and reducing dissolved gases in said water tube bundle sections and improving condenser performance, which comprises one or more of:

(a) identifying that air binding is caused primarily by steam scavenging of air to locations within a tube bundle or bundle section locations not having an ARS;

(b) modifying the flow path through the said bundle or said bundle sections to redirect the flow of scavenged air more toward the air removal section but through the said tube bundle or the said bundle section;

(c) changing the bundle layout pattern to promote steam and air flow direction within the tube bundle toward the ARS; and (d) eliminating access paths directly to the ARS inlet for steam to flow from outside the tube bundle which can interfere with the flow of air rich steam or water vapor into the ARS for extraction of air and other noncondensables through the vent line.

16. The method of claim 15, comprising one or more the steps of:

(a) placing a barrier at some depth around said ARS vent line and between tube bundle sections to prevent entering steam from flowing deep into the gap between said water tube bundle sections; or (b) placing steam flow barriers at some depth between the outer and inner edges of said condensate trays and extending upwardly and downwardly from said condensate trays to said water tube bundle sections, the flow of condensate in said condensate trays not being impeded by said steam flow barriers.

17. The method of claim 15, which further comprises:

(c) placing low profile liquid barriers upwardly from said condensate trays and outwardly from said steam flow barriers to form a liquid trap to further restrict steam flow from outside said water tube bundle sections inwardly adjacent to said condensate trays, the flow of condensate outwardly in said condensate trays not being impeded by said liquid traps.

18. The method of claim 15, which further comprises one or more of:

(d) placing dams in each condensate tray at about the anticipated limit of the outer boundary of said stagnant air zone for preventing subcooled condensate in said condensate trays in said stagnant air zone from leaving said stagnant air zone in an outward direction away from said stagnant zone;

(e) drains placed beneath each condensate tray disposed within said stagnant air zone for diverting subcooled condensate in said condensate trays in said stagnant air zone running off said condensate trays for collection;

(f) baffles placed through each tube bundle above and below said stagnant air zone to prevent condensate from passing into said stagnant air zone; or (g) placing baffles through each tube bundle section below said stagnant zone for diverting any subcooled condensate to a collection trough placed below said stagnant zone for collection of said subcooled condensate.

19. The method of claim 18, wherein said diverted subcooled condensate in said drains is subject to deaeration.

20. The method of claim 19, wherein said diverted subcooled condensate in said drains is placed in contact with said inlet steam for release of dissolved gases.

21. The method of claim 18, wherein said baffles are perforated.

22. A method for operating a condenser of the type having a housing inside of which is disposed a bundle of heat exchange tubes, a process fluid vapors inlet for process fluid vapors to flow inside said housing for contacting said tube bundle for heat removal, and having a stagnant zone of higher gas concentration during operation wherein any air in-leakage or other non-condensable gases preferentially collect and condensate in or passing through said stagnant zone becomes subcooled allowing said gases to become partially absorbed, the improvement for reducing the dissolved gases content in said subcooled condensate which comprises the steps of:

(a) placing a drain beneath said stagnant air zone for collecting subcooled condensate from said stagnant air zone;

(b) transporting collected subcooled condensate in said drain to said process fluid vapors inlet;

(c) dispersing said transported condensate with a spreader for contacting small spray-type droplets of condensate with process fluid vapors entering said condenser, whereby said injected condensate is heated by said process fluid vapors for expelling dissolved gases in said injected condensate.

* * * * *